US005983420A

United States Patent [19]

Tilley

[11] Patent Number: 5,983,420

[45] Date of Patent: Nov. 16, 1999

[54] FURNITURE FOR A STANDARDIZED ROOM

[75] Inventor: Max L. Tilley, Falcon, Colo.

[73] Assignee: The United States of America as represented by the Secretary of the Air Force, Washington, D.C.

[21] Appl. No.: 08/909,441

[22] Filed: Jul. 28, 1997

Related U.S. Application Data

[63] Continuation of application No. 08/514,879, Aug. 14, 1995, abandoned.

[51] Int. Cl.[6] ..... A47C 19/20; A47B 17/00; A47B 88/04; F16D 1/00

[52] U.S. Cl. ..... 5/2.1; 5/9.1; 5/282.1; 5/285; 5/308; 52/36.4; 108/91; 312/196; 312/265.3; 312/334.7; 403/171; 403/217

[58] Field of Search ..... 5/2.1, 9.1, 10.1, 5/200.1, 201, 282.1, 285, 308; 248/165, 918; 52/27, 36.1, 36.4; 312/196, 223.3, 235.1, 235.2, 265.3, 265.4, 265.1, 265.2, 334.12, 334.18, 334.7, 330.1, 348.4; 108/50, 91, 153, 180, 182; 297/283.2, 232, 411.26, 440.1, 440.14, 452.2; 403/169, 170, 171, 176, 215, 217

[56] References Cited

U.S. PATENT DOCUMENTS

| | | | |
|---|---|---|---|
| Re. 34,266 | 6/1993 | Schairbaum | 108/23 |
| D. 339,571 | 9/1993 | Drabczyk et al. | D14/103 |
| D. 340,229 | 10/1993 | Drabczyk et al. | D14/103 |
| 2,432,379 | 12/1947 | Butler | 5/2.1 |
| 2,483,938 | 10/1949 | Royston | 5/308 |
| 3,338,648 | 8/1967 | Bannister | 5/8 |
| 3,688,458 | 9/1972 | Inmon et al. | 52/280 |
| 4,053,192 | 10/1977 | Spetner | 312/107 |
| 4,312,086 | 1/1982 | Bianco | 5/2 R |
| 4,337,988 | 7/1982 | Schenck | 312/250 |
| 4,378,137 | 3/1983 | Gibson et al. | 312/265.3 |
| 4,421,366 | 12/1983 | Niziol | 312/257 A |
| 4,869,564 | 9/1989 | Lechman | 312/195 |
| 5,066,161 | 11/1991 | Pinney | 403/172 |
| 5,094,174 | 3/1992 | Grund et al. | 108/50 |
| 5,572,751 | 11/1996 | Brandt | 5/2.1 X |
| 5,713,650 | 2/1998 | King et al. | 5/2.1 X |
| 5,820,289 | 10/1998 | Kern et al. | 403/217 X |

FOREIGN PATENT DOCUMENTS

| | | | |
|---|---|---|---|
| 789464 | 1/1958 | United Kingdom | 5/8 |

OTHER PUBLICATIONS

Exhibits 1A to 4A show a prior metal type furniture system used in a dormitory. Photos will be sent upon receipt of serial number.

Exhibits 1B–3B disclose a prior wood type furniture system used in a dormitory room.

*Primary Examiner*—Terry Lee Melius
*Assistant Examiner*—Robert G. Santos
*Attorney, Agent, or Firm*—Stanton E. Collier

[57] ABSTRACT

A sleeping unit for furnishing a standardized room having two dresser units thereunder is disclosed. Each dresser unit comprises a rectangular box-like frame constructed of 1×1 aluminum tubing and welded joints. The frame has a base which is constructed of 1×2 aluminum tubing and welded joints connected to the 1×1 tubing. The tubing has flanges thereon for the attachment of two panels which are inserted into the frame to form outer surfaces thereon, and each panel has a durable coating thereon. Each dresser unit also comprises a pair of inner frames with drawer slides thereon, wherein the inner frames are attached inside and thereto the box-like frame, and a rear inner frame having two openings therein defining two slots. Each slide has a single screw secured onto a front end thereof. A rear of each slide rests in a respective slot of the rear inner frame whereby each slide is easily removable for repair by removing the screw on the front of the slide. This allows each slide to be removed without further effort. A pair of drawers is mounted to the drawer slides.

5 Claims, 30 Drawing Sheets

ALUMINUM BED FRAME
118
NUT-SERT
116
120
THR'D. BLOCK USED FOR ALIGNMENT & SECURING BED BOARD
DRESSER FRAME 124
126
112
128
122
HEAD BOARD PANEL 3/4" PLYWOOD HPL TWO SIDES

C
7
106
D
114
110
BOTTOM OF BED
ALIGNMENT BLOCKS

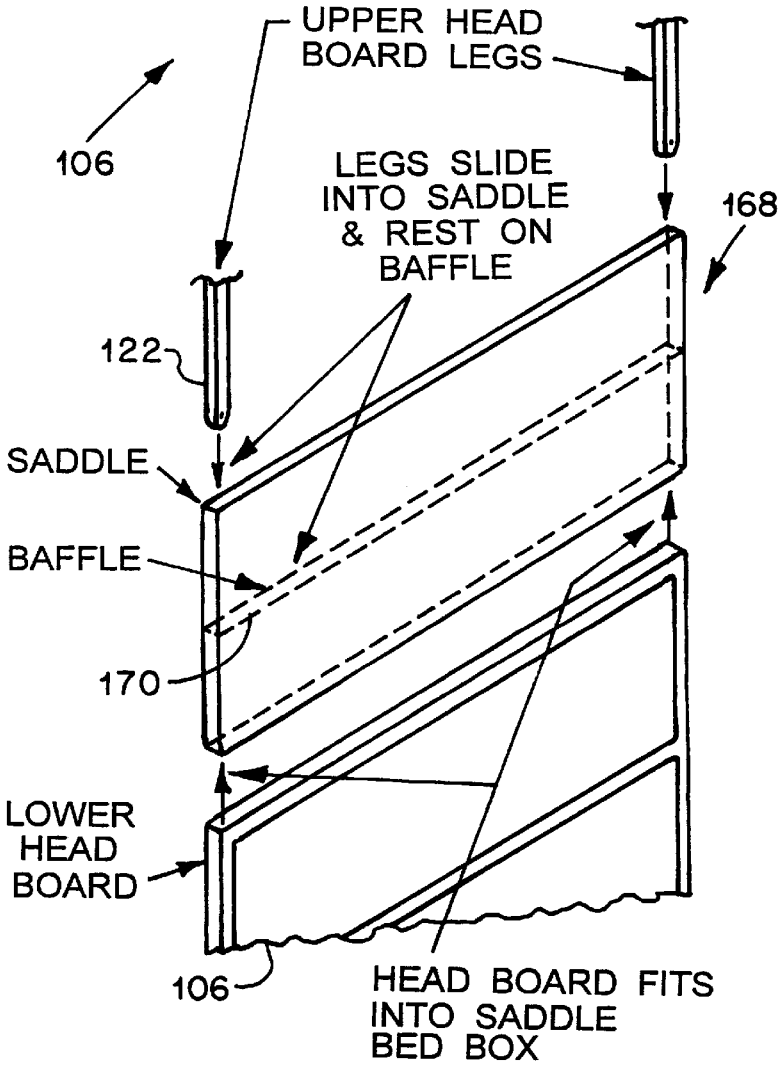
FIG. 7G(1)
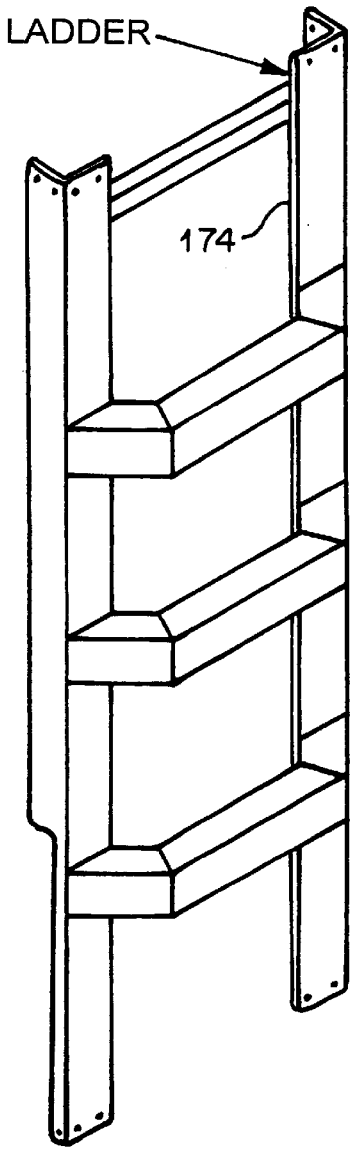
FIG. 7G(2)

FIG. 7I(1)

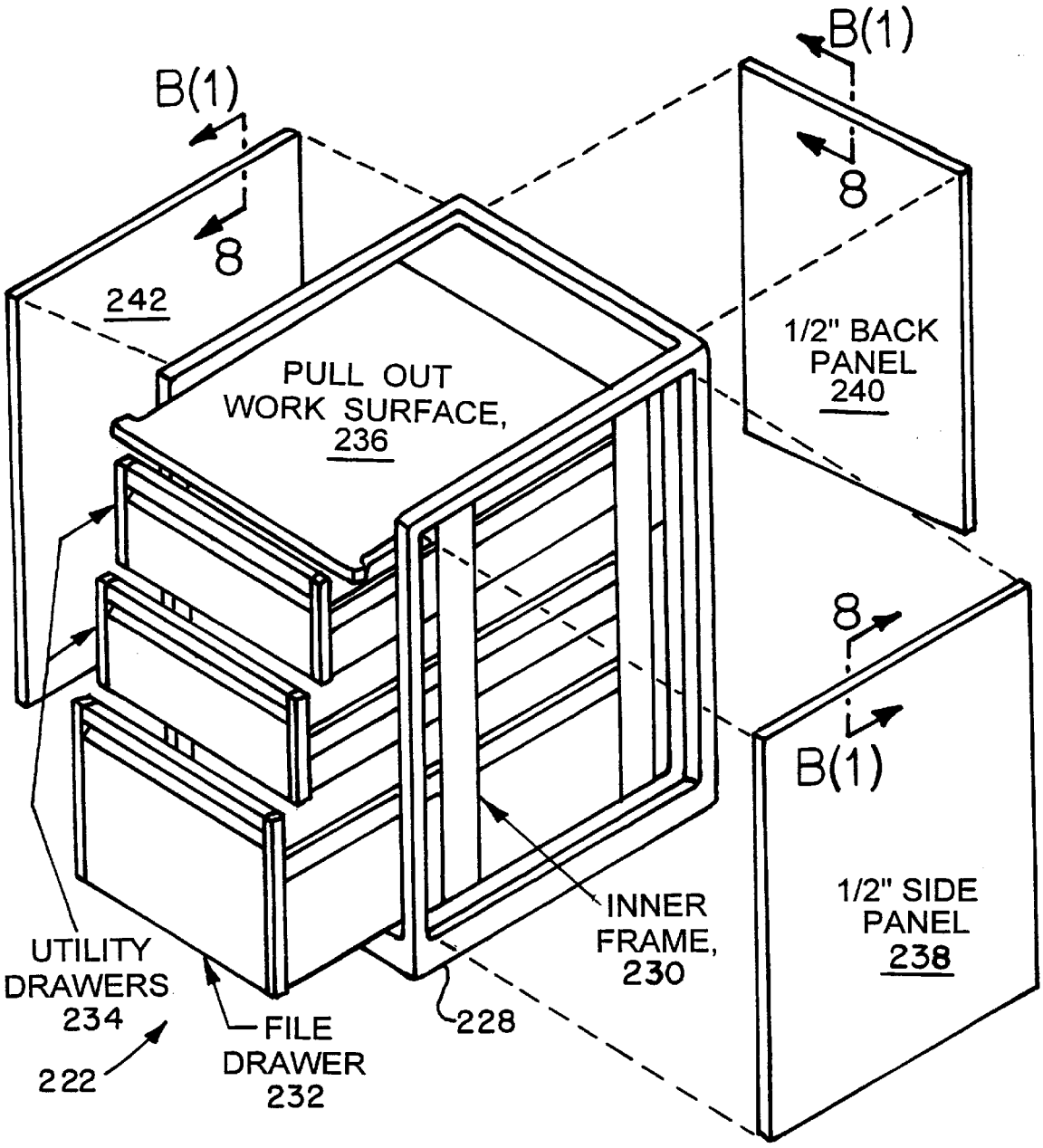
FIG. 8B
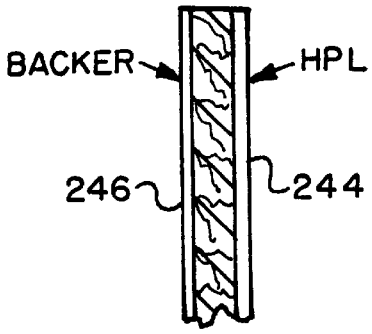
FIG. 8B(1)

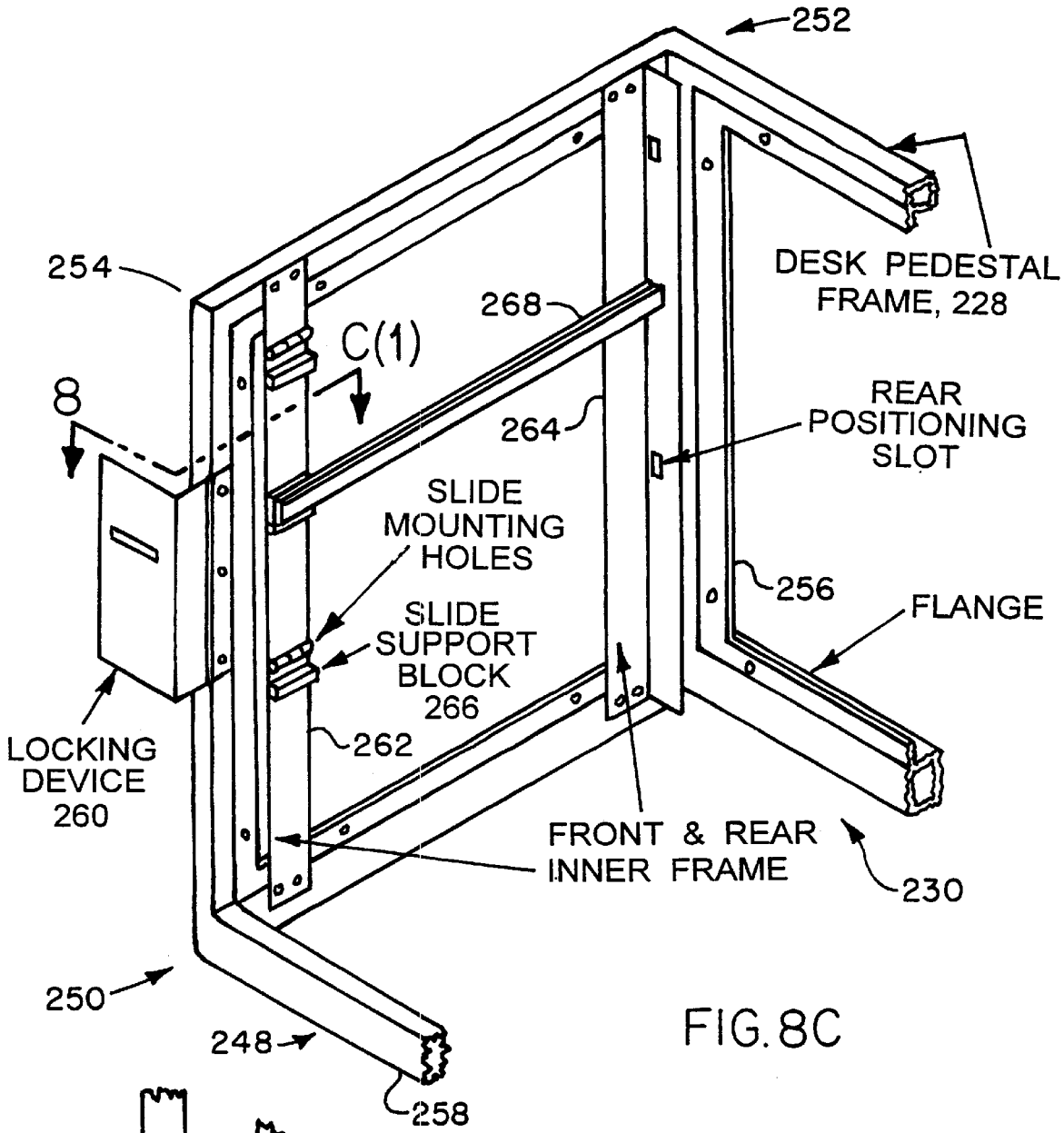
FIG. 8C
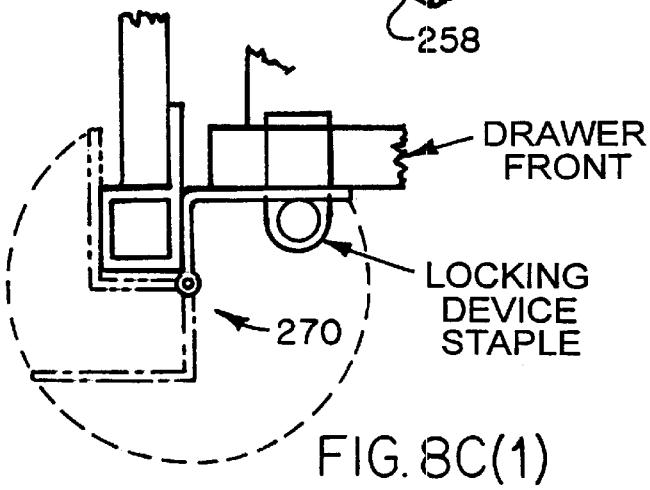
FIG. 8C(1)

232
SLAT
SLAT
272
SLAT
HAT CHANNEL WELDED TO BOTTOM OF DRAWER
FIG. 8E(1)
FIG. 8E(3)
END PLUG
FIG. 8E(2)

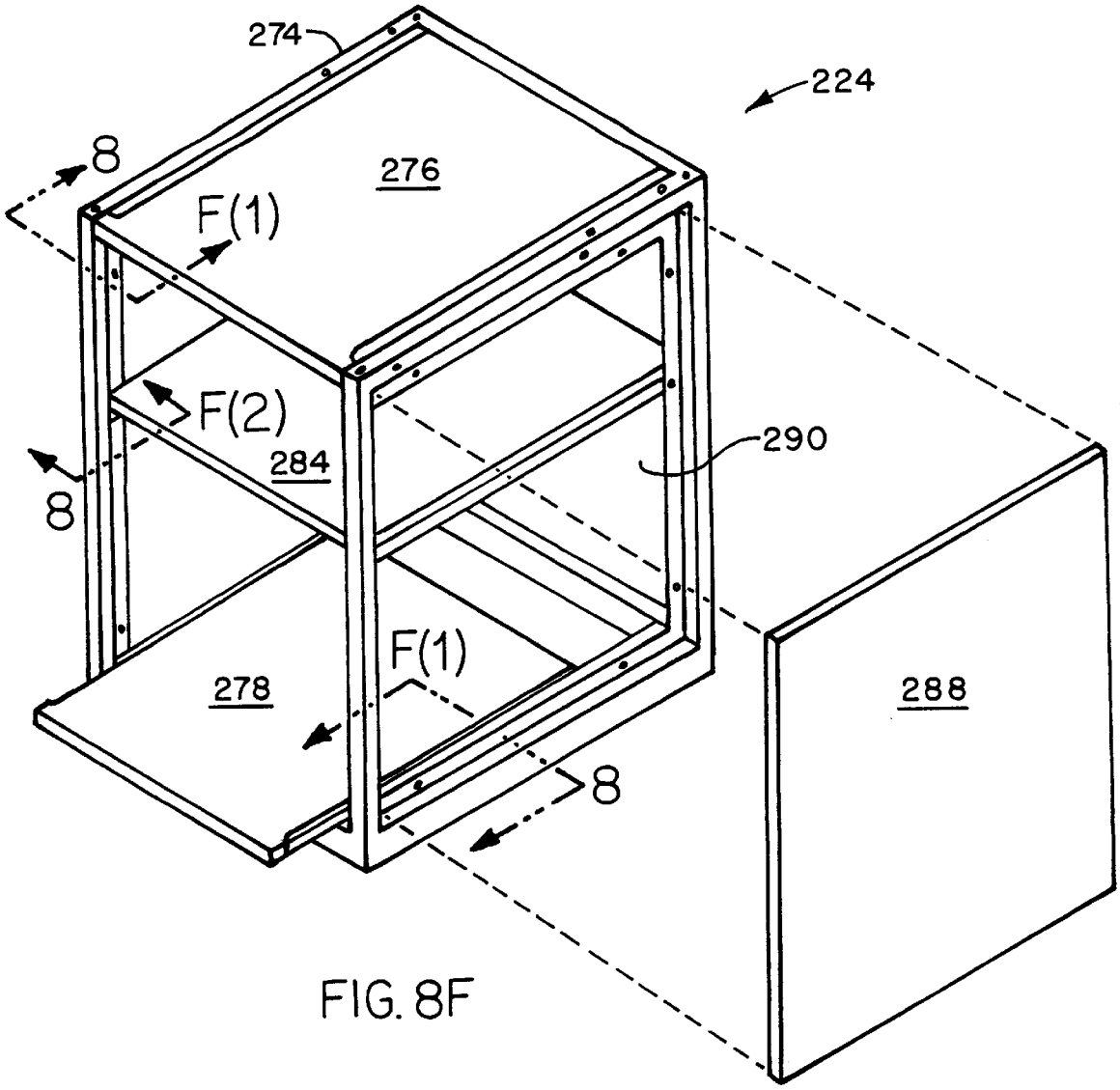
FIG. 8F
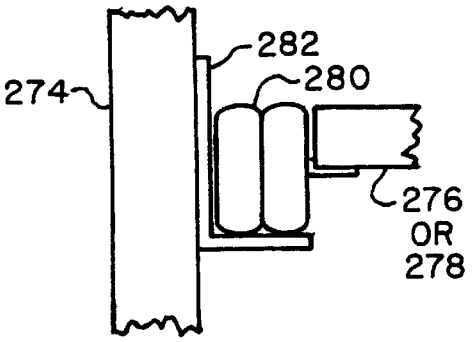
FIG. 8F(1)
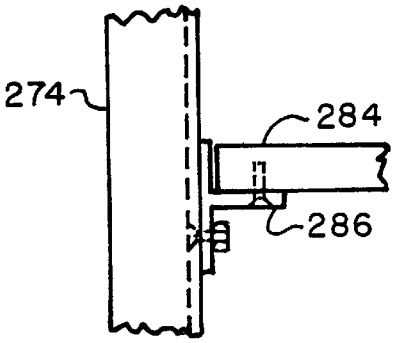
FIG. 8F(2)

FIG. 8I(1)

TOP
178
224
8M
222
SHELF
220
8N
BULLETIN BOARD FRAME
SHELF
218
186
216
80
8P
214
184
182
53

3/4" PLYWOOD SHELF HPL TWO SIDES
40

3/4" PLYWOOD SHELF HPL TWO SIDES
BACK & SIDES 1/2" PLYWOOD HPL TWO SIDES
52
EXTRUDED ALUMINUM FRAME

1/4" PLYWOOD
HPL
184
BULLETIN BOARD
1/4" CORK

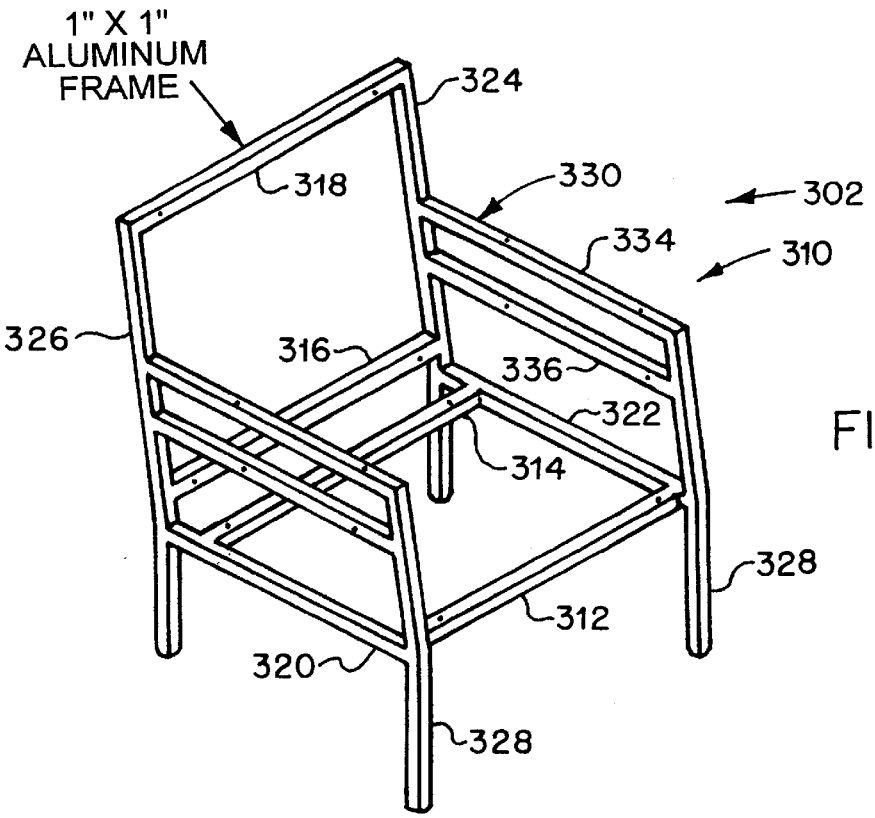
FIG. 9A(1)
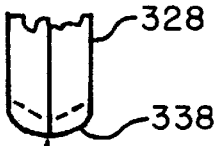
FIG. 9A(3)
SOLID ALUMINUM CAP, ROUNDED CORNER WELDED TO LEG
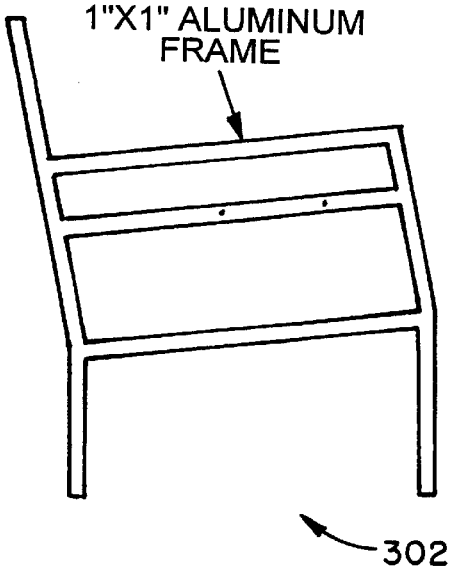
FIG. 9A(2)

364
366
362
WOOD FRAME
DIWATROL
2" FOAM
FABRIC

360

TEE-NUTS
308
UPHOLSTERY 372
1" FOAM, 370
1/2" PLYWOOD 368
CHAIR & SOFA LEFT ARM PAD
CHAIR & SOFA RIGHT ARM PAD

CUSHIONS ARE REVERSABLE & INTERCHANGABLE AND FIT CHAIRS AND SOFAS
306
304
9E

FURNITURE FOR A STANDARDIZED ROOM

This application is a continuation of application Ser. No. 08/514,879, filed Aug. 14, 1995, now abandoned.

STATEMENT OF GOVERNMENT INTEREST

The invention described herein may be manufactured and used by or for the Government for governmental purposes without the payment of any royalty thereon.

BACKGROUND OF THE INVENTION

The furnishing of dormitory style rooms, in the past, has been very expensive when one desired durable furniture, attractive furniture and maintainable furniture.

For example, in the past, furniture used in the dormitory style rooms was of particle board construction and plastic laminate with some items such as chairs, tables and ladders being made of real wood. In the loft system, this furniture was very heavy and weighed over 1200 pounds per unit and thus was difficult to move for any reason. The plastic laminate is prone to separating and breaking and thus the system becomes a maintenance nightmare. The wooden furniture is further prone to joint failure and general marring of the surface. Because of these problems, a full time staff is required to repair and replace this style of furniture and if there are many rooms, in the hundreds, this becomes a very large and expansive task.

Thus, there exists a need for a means of furnishing standardized rooms in a flexible manner preventing many of the problems associated with less adaptable furniture.

SUMMARY OF THE INVENTION

The present invention provides a system for furnishing standardized rooms such as dormitory rooms.

The dormitory room of concern is approximately 13 by 18 feet with an entrance door, two side-by-side closets which are built into the room, and a sink vanity located on the interior wall near the door. The dormitory room may be furnished for either 2 or 3 persons with the arrangement of the furniture being flexible. In the three person room, there are three beds with one being a bunk bed. The floor beds may have two underbed dressers. There will be three desks with chairs with desk mounted bookcases along with three bulletin boards therein. A free-standing bookcase may be included. In the two person room, a desk is replaced with two lounge chairs and one lamp table. A common area TV room will have at least one lamp table, one two-seat sofa, one three-seat sofa, numerous lounge chairs, 1 free-standing bookcase and a table. These configurations are adjustable to a high degree within a particular style.

The furniture system is user friendly in that it can be totally dismantled, reconfigured, maintained, and repaired with the use of a single phillips screw driver. Cleaning and lubricating are also user accomplished. All frames are made of lightweight aluminum tubing with a low maintenance finish. Structural tubing is extruded with flanges thereon for attachment purposes with interchangability of parts. Most joints are formed between the tubing with cast joints which are welded to the tubes. Each furniture module consists of an aluminum frame with casing panels mounted thereon as appropriate.

The sleeping unit may consist of a single bed with two dresser units under the bed and providing support thereto. A stacking unit may be connected to the single bed unit by use of a saddle and head board and a ladder unit. The desk and bookcase thereon has a drawer pedestal and a computer pedestal which support a desk top. The bookcase is mounted on top of the desk top. The pedestals may be interchanged left to right. The seating may consist of lounge chairs, two seat sofas and three seat sofas. The seats and backs are interchangeable as well as the arm rests from unit to unit which insures the greatest maintainability. Each modular unit may be disassembled to a basic frame with the use of a single screw driver. Panels installed in the modular units are covered with high density plastic over a furniture grade of plywood. If the panels are exposed on both sides, each side is cover with plastic otherwise, a backer material is applied instead.

Therefore, one object of the present invention is to provide a furniture system for standardized rooms such as dormitory rooms which provides flexibility in placement.

Another object of the present invention is to provide a furniture system which is totally user friendly.

Another object of the present invention is to provide a furniture system which has a service life of about 50 years.

Another object of the present invention is to provide a furniture system wherein the seating, chair and sofa, have interchangeable parts.

These and many other objects and advantages of the present invention will be readily apparent to one skilled in the pertinent art from the following detailed description of a preferred embodiment of the invention and the related drawings.

BRIEF DESCRIPTION OF THE DRAWINGS

FIGS. 7A to 7I illustrate both the single and double sleeping units of the present invention.

FIGS. 9A to 9G illustrate a single chair, two seat sofa and a three seat sofa of the present invention.

DETAILED DESCRIPTION OF THE PREFERRED EMBODIMENT

Figure 1:
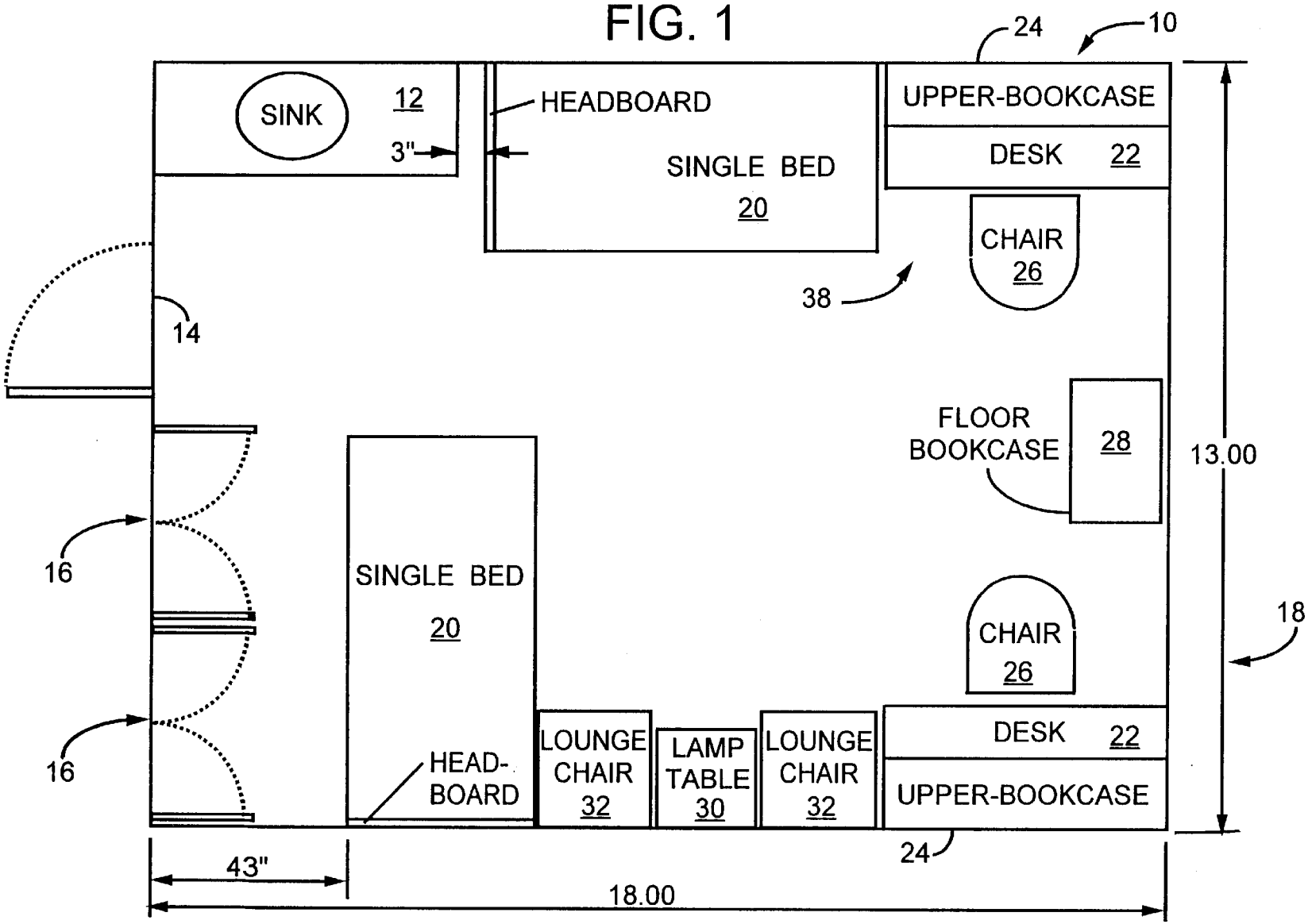
FIG. 1 illustrates the present invention as applied to a two person style dormitory room.
Figure 2:
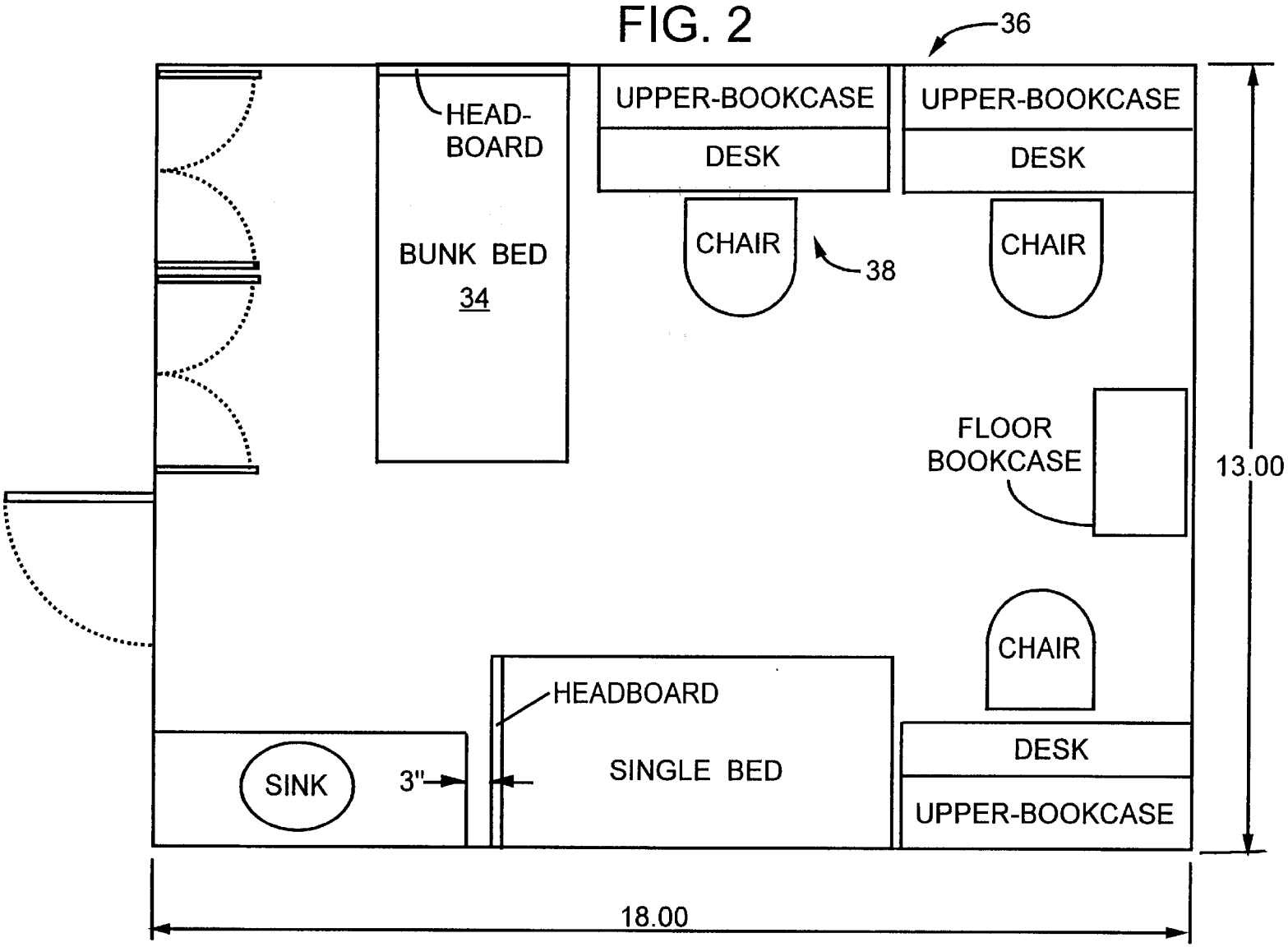
FIG. 2 illustrates the present invention as applied to a three person style dormitory room.
Figure 3A:
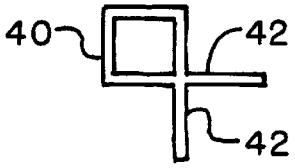
FIGS. 3A to 3I illustrate various extruded aluminum structural tubes for use in the present invention.
Figure 3B:
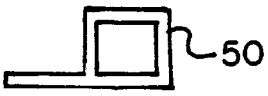
Figure 3C:
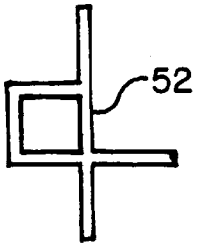
Figure 3D:
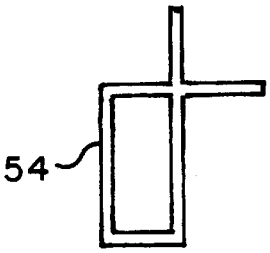
Figure 3E:
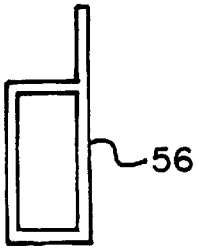
Figure 3F:
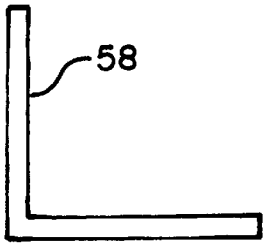
Figure 3G:
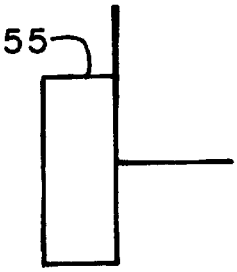
Figure 3H:
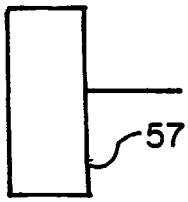
Figure 3I:
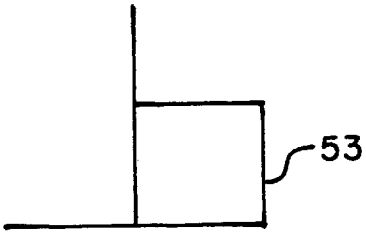

Referring to FIG. 1, a two person dormitory style room 10 is shown have the approximate dimensions of 18 by 13 feet. In this room is a sink vanity 12 located near a door 14 and two closet units 16. The position of the vanity 12, the door 14 and the closet units 16 may be reversed as seen in FIG. 2. A window 18 is normally located on the wall opposite the door 14.

The furniture for the two person room is seen as two single beds 20, two desks 22 having bookcases 24 thereon with desk chairs 26. The desk 22 and bookcase 24 thereon will be referred to as a desk unit 38. A floor bookcase 28, a lamp table 30, and two lounge chairs 32 are also provided.

Referring to FIG. 2, a three person dormitory style room 36 is shown. The single bed 20 of the two person dormitory style room has a bunk section added thereon as well the replacement of the lounge chairs 32 and the lamp table 30 with another desk unit 38.

In a TV lounge area or common area, for example, seating may be provided by numerous lounge chairs 32 and/or two seat sofas and/or three seat sofas. Floor bookcase(s) 28 will provide for storage of books and magazines as well as a place to mount a TV. A table may further be provided which may be similar to a lamp table herein disclosed but larger in size.

The furniture system provided will have a lifetime of 50 years. The furniture units are designed to maximize usable floor space in a typical dormitory style room. Each unit is designed to minimize weight. Each unit where applicable allows the user to change parts, dismantle, reconfigured, and maintain with the use of only one tool, a number two phillips head screw driver. The only lubrication required is of the mechanical drawer slides. All surface can be cleaned with mild soap and water solution.

To minimize maintenance costs and the frequency of repairs, the external frame is constructed of one by one inch aluminum tubing and all the joints are welded to provide strength and rigidity. The aluminum frame is finished with a powder coating process to provide a finish that only requires cleaning with soap and water and is very resistant to chipping and scratching In general each furniture module has an aluminum frame with casing panels mounted inside the frame and secured with countersunk screws through flanges located on the inside of the frame tubing. The casing panels are inset inside the aluminum frame which protects the casing panels from being scratched and dented and protects the edges of the panels. The casing panels are constructed of high pressure plastic laminate (HPL) over a furniture grade plywood substrate of appropriate thickness to be inset and provide adequate support.

Figure 4A:
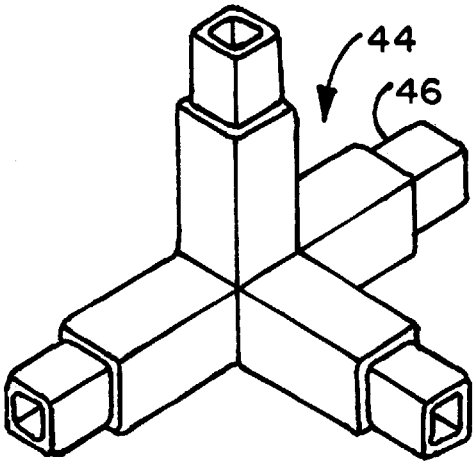
FIGS. 4A to 4G illustrate various cast insert joints used for the present invention between the tubes of FIG. 3.
Figure 4B:
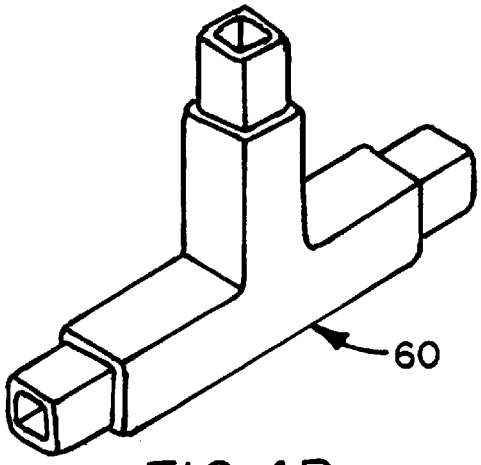
Figure 4C:
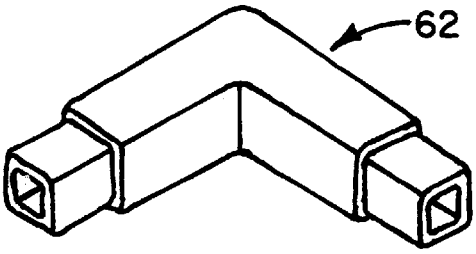
Figure 4D:
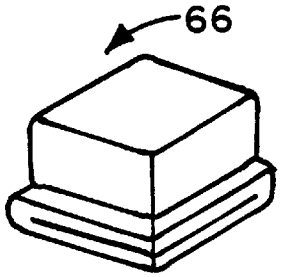
Figure 4E:
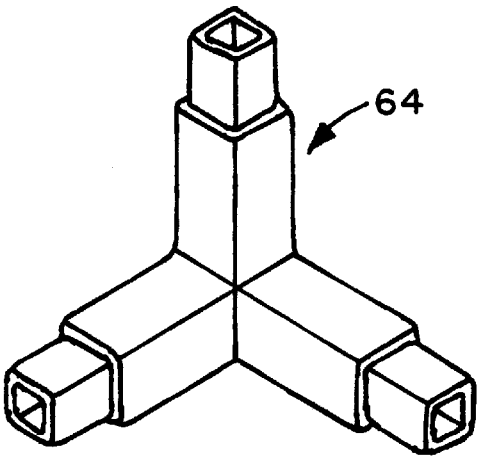
Figure 4F:
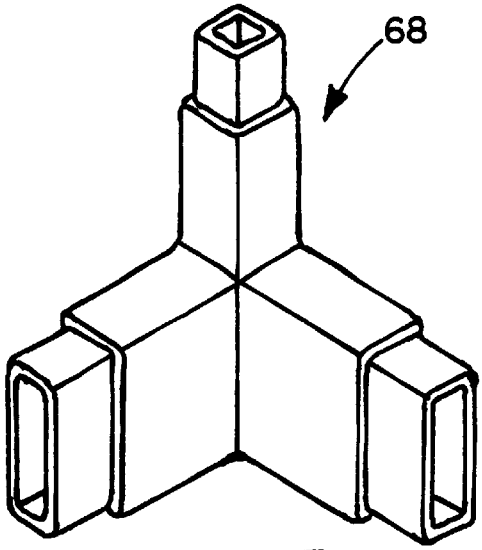
Figure 4G:
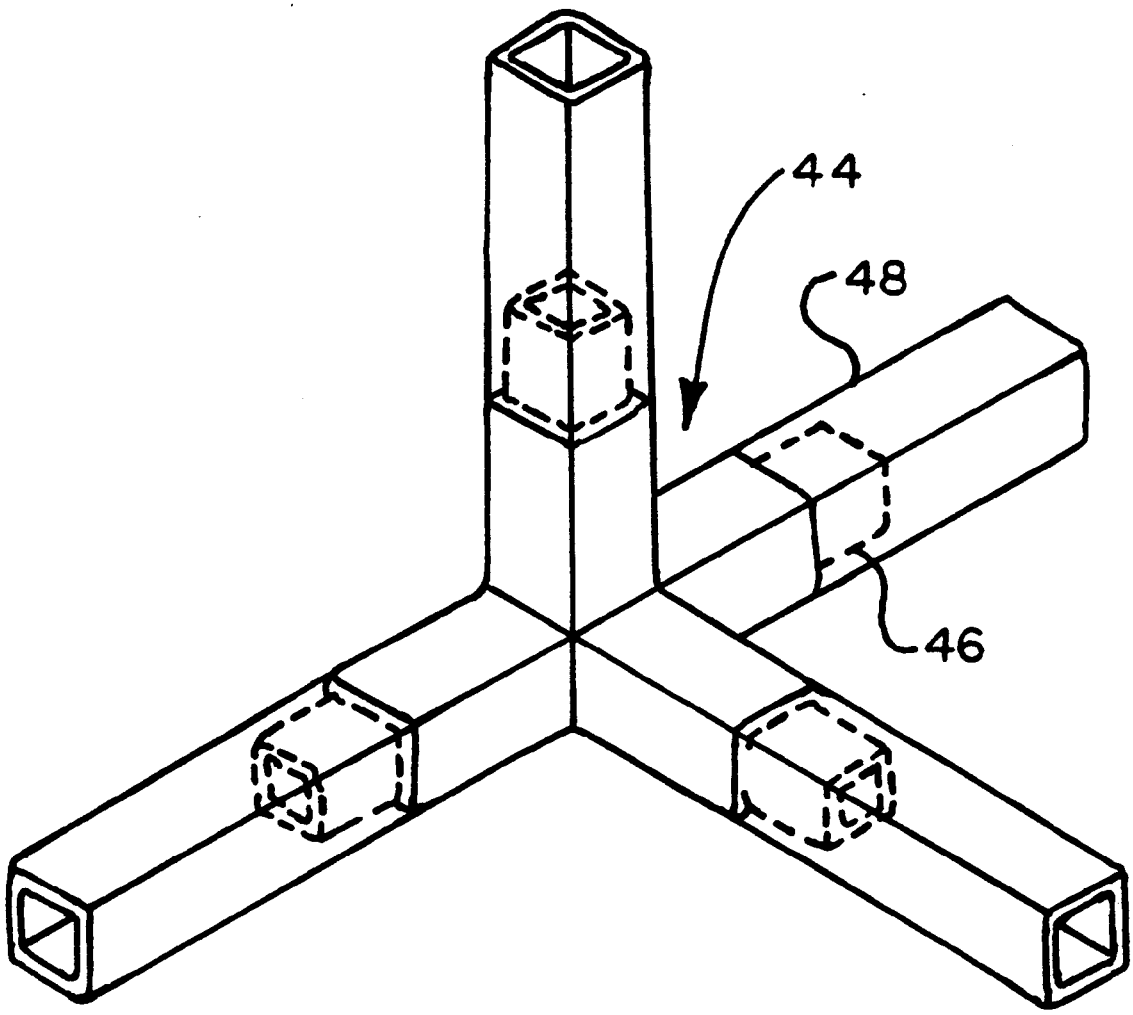

Referring to FIG. 3, each furniture module to be detailed herein below is constructed from a combination of one by one inch tubing with flanges thereon, 42, 50 and 52, FIGS. 3A to 3C, one by two inch tubing with appropriate flanges thereon, 54 and 56, FIGS. 3D and 3E, and right angle stock, 58, FIG. 3F. For example, a tube piece 40 in FIG. 3A has a pair of flanges 42 projecting from one edge. These flanges would have holes therein for receiving screws. Tube piece 40 may be a corner with casing panels on each side thereof. These tubings are appropriately connected with a variety of aluminum joints, 44, 60, 62, 64, 66 and 68, FIG. 4A to 4F. FIG. 4A illustrates the joint 44 for joining four tubing pieces. An insertion end 46 fits closely within the one by one inch tubing 48 as seen in FIG. 4G. After appropriate welding and grinding and sanding, the joint lines would be covered with the finish and thus be invisible.

Figure 5A:
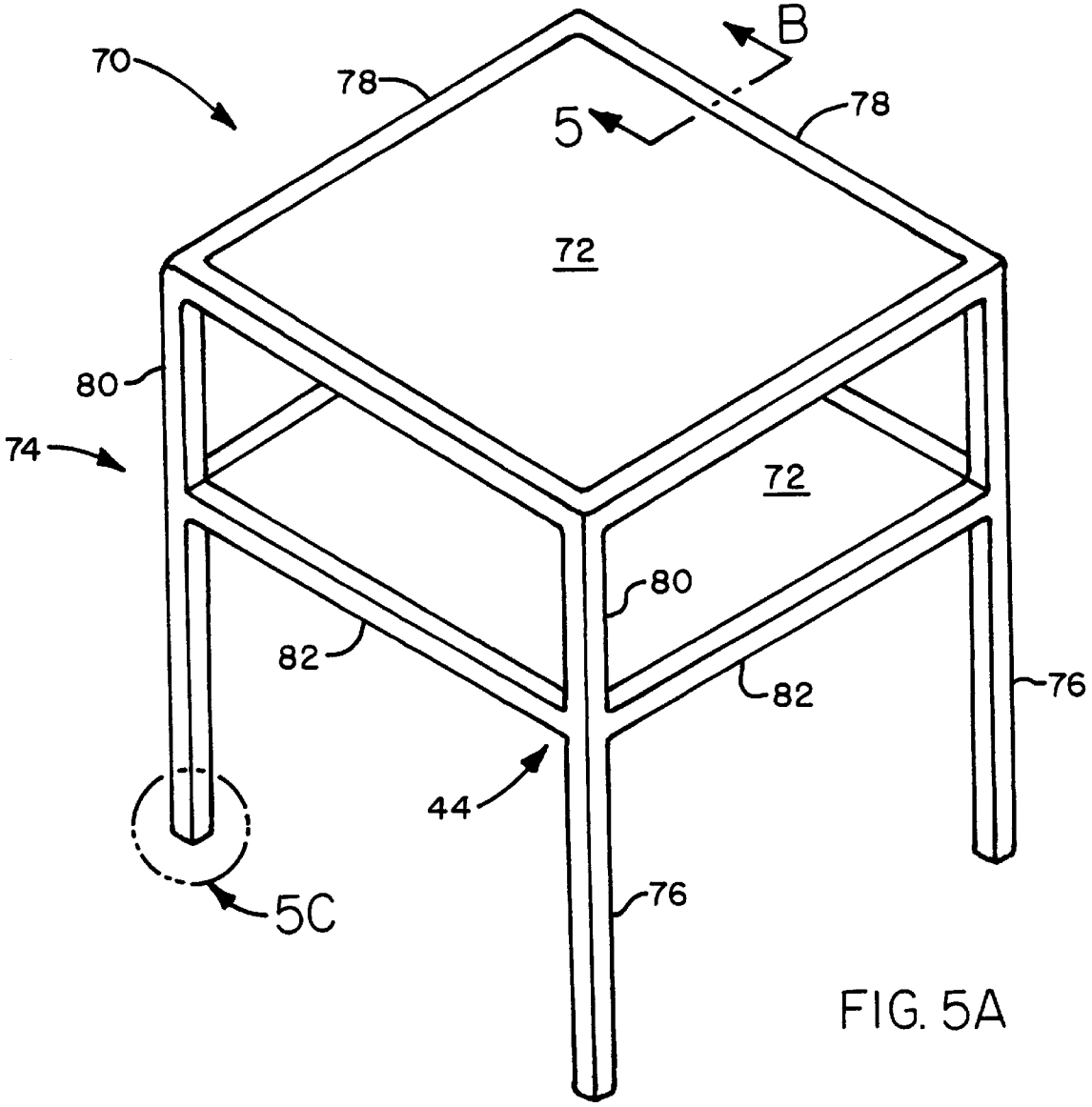
FIG. 5A to 5C illustrate a table, in particular, a lamp table of the present invention.
Figure 5B:
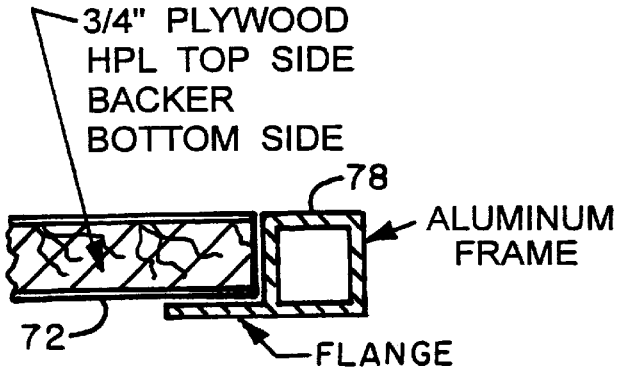
Figure 5C:
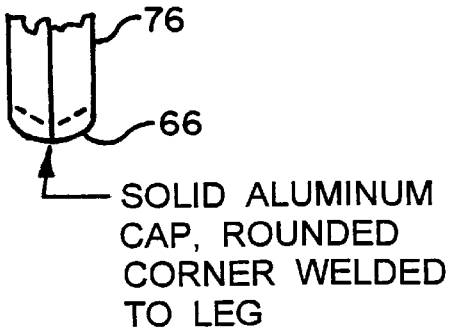

Description of Lamp Table:

A lamp table 70 is shown in FIG. 5A. The table 70 has two casing panels 72 mounted within an integrated aluminum frame 74. Each leg 76, having four, has an end cap 66 jointed therein, FIG. 5C. Four upper edge sections 78, of tubing 50, are jointed by joints 64. The four intermediate supports 80 are joined to joints 44 with legs 76 and the lower edge sections 82 of tubing 50. All joints are welded and the joint lines sanded smooth. The surface of the integrated frame 74 then has the powder coating applied. The lamp table 70 may be enlarged to produce a card table, not further shown, has the same basic construction and features.

Figures 6A, 6C:
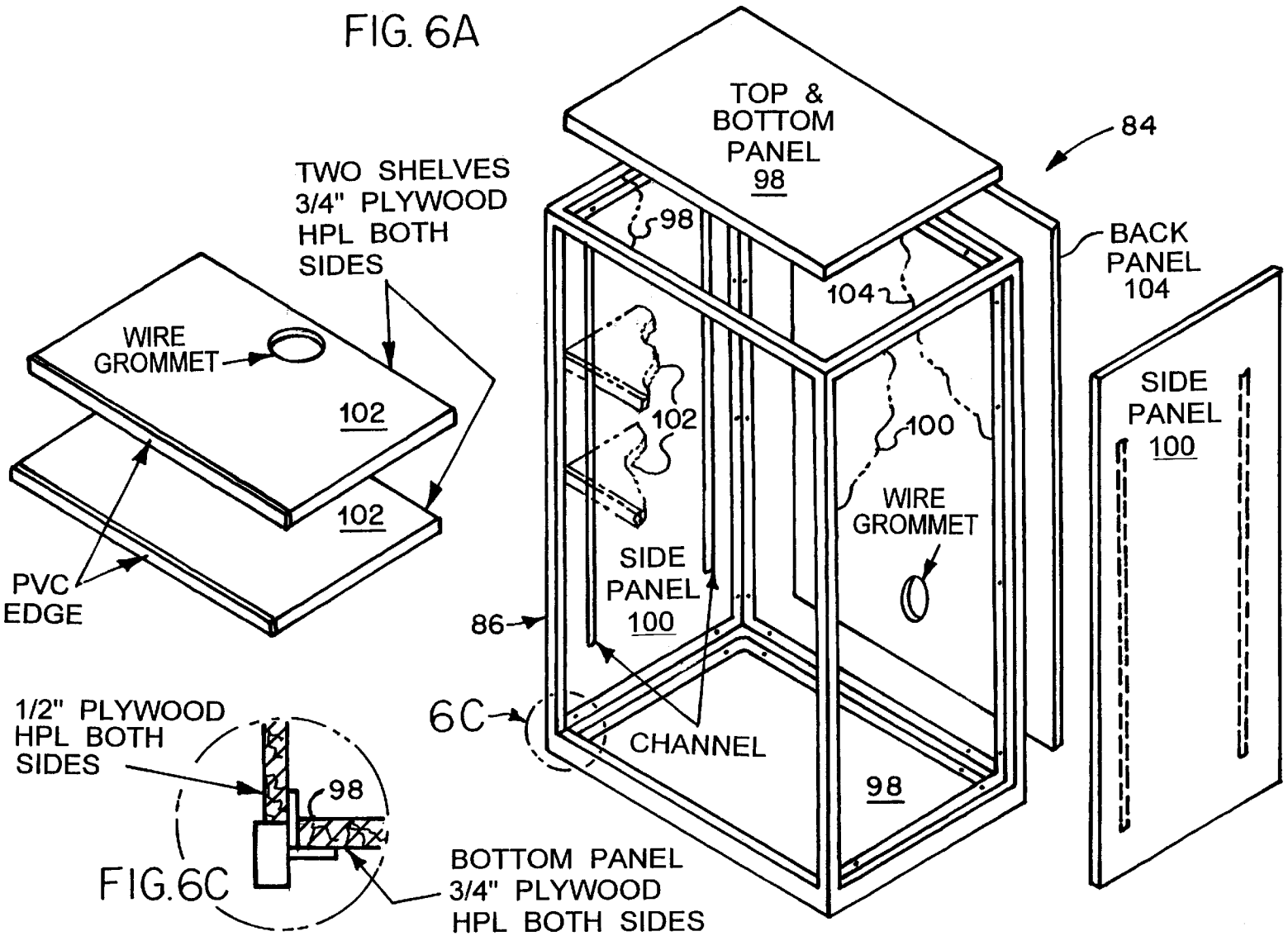
FIG. 6A to 6C illustrate a floor bookcase of the present invention.
Figure 6B:
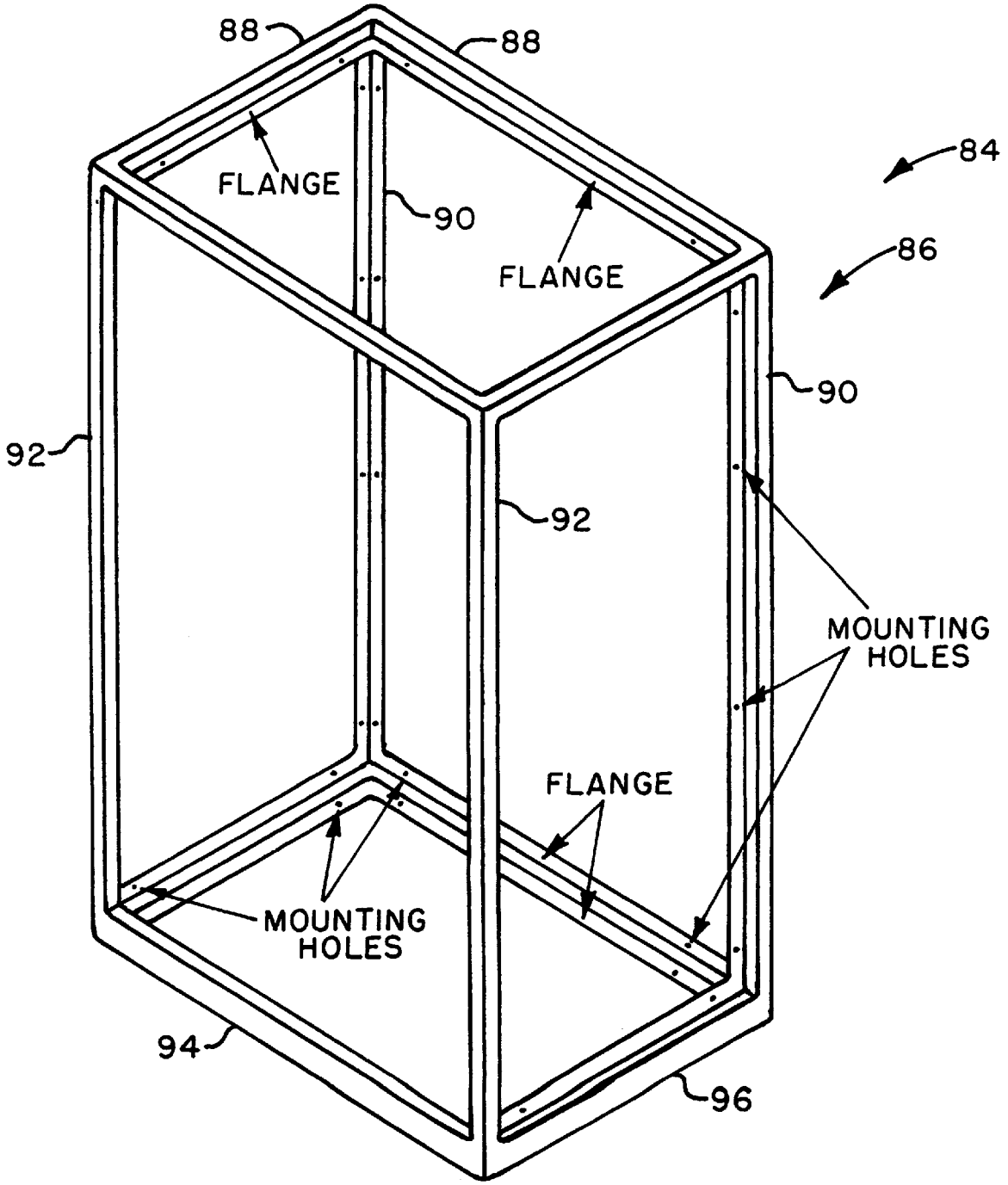

Description of Bookcase:

A floor bookcase 84 is shown in FIG. 6A in exploded view. An integrated floor bookcase frame 84 is shown in FIG. 6B. The upper edge sections 88, being tubing 50, are connected to the vertical supports 90, being tubing 40, and vertical supports 92, being tubing 50, by joints 64. The base of bookcase 84 has a front edge section 94, being tubing 57, 1 by 2 inch, and side and back edge sections 96, being tubing 55. These sections are jointed to the vertical supports 90 and 92 by means of joints 68. A top and bottom panel 98 are mounted into the recesses formed by the integrated frame 86 and screwed therein. Side panels 100 are mounted in the frame 86. The side panels have shelf mounting hardware thereon for holding at least two shelves 102. All panel has HPL on both sides because of exposure. The thickness of the panels is either ½ or ¾ inch depending on whether it supports weight. A back panel 104 is mounted on the frame 86.

Figure 7A:
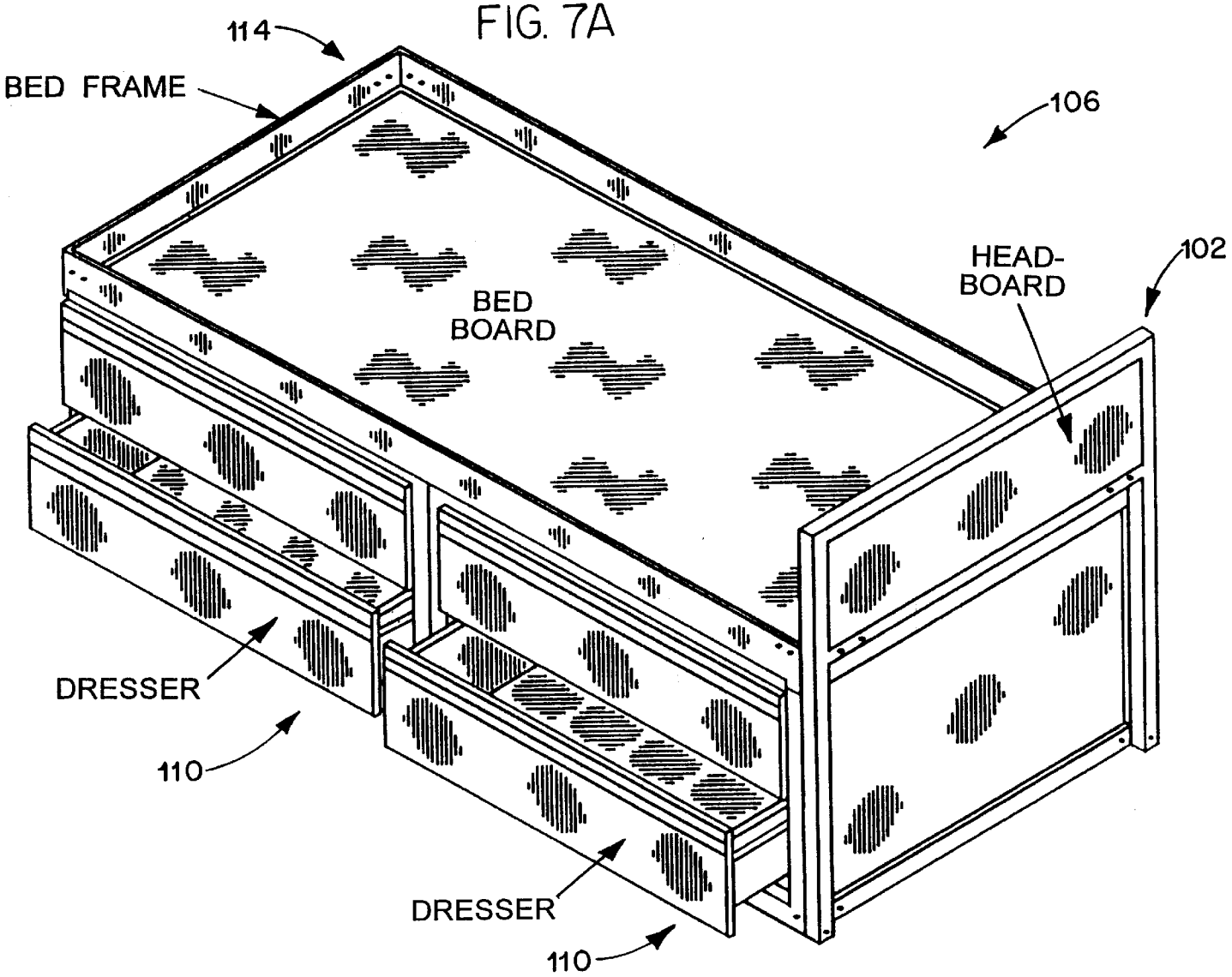
Figures 7B, 7C, 7D:
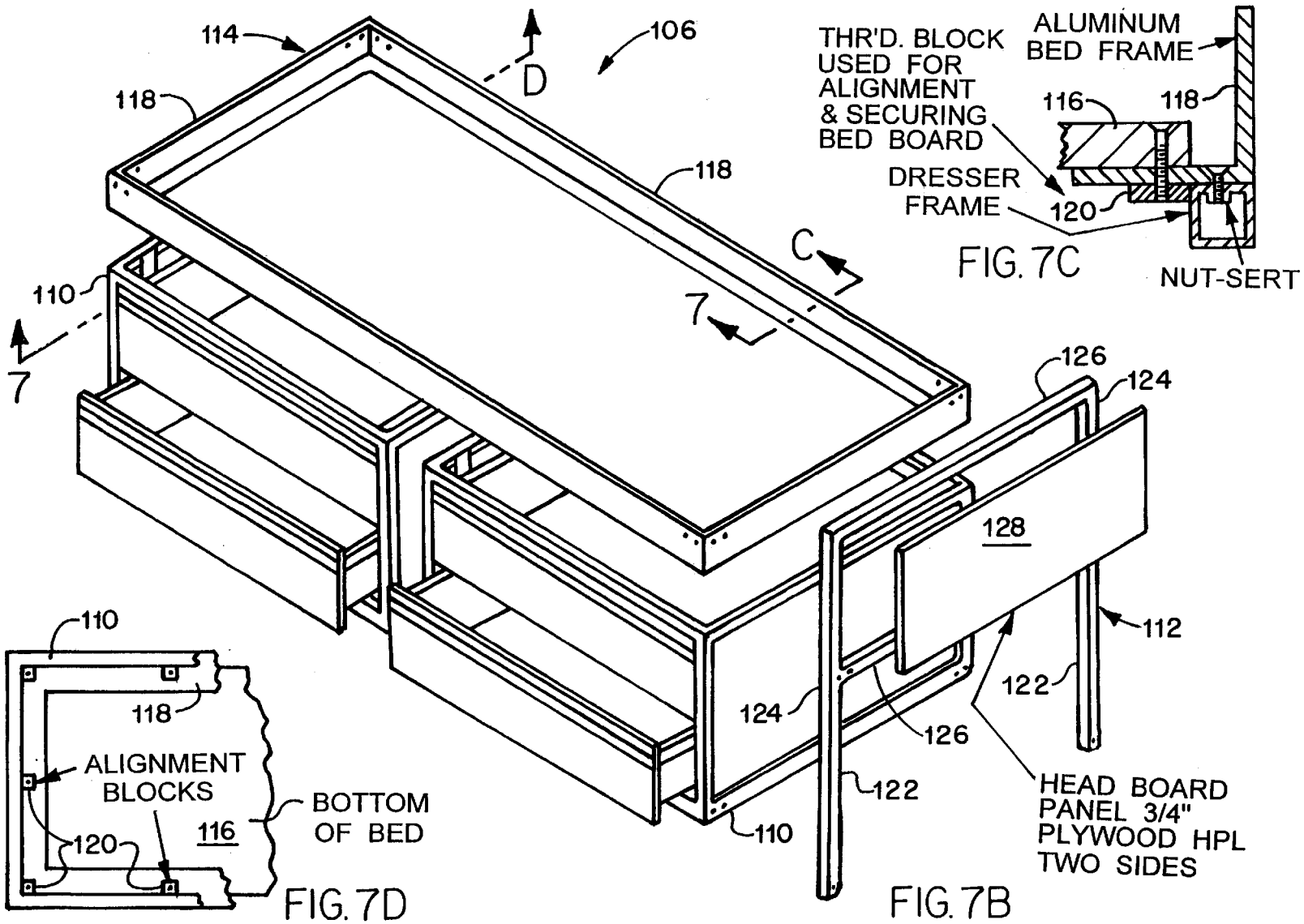

Description of Sleeping Units:

As to the sleeping unit, reference is made to FIGS. 7A and 7B which illustrates a single bed and dresser unit dresser 106 and FIGS. 7C and 7D which illustrate the bed, dresser and stacking unit 108 combination. The dresser 106 is made up of two dresser units 110. These units not only serve as beds but provide additional space for storage.

As seen in FIG. 7A, the single bed unit 106 consists of two adjacent dresser units 110 which can be reversed, a head board 112, which can be reversed end to end, and a bed frame 114 which are all interconnected to provide a single structural unit.

The bed frame 114 has a bed board 116 which is attached by screws to four L shaped aluminum sides 118. Alignment blocks 120 acting as nuts for the bed board screws and as alignment devices for positioning the frame 114 over the top of the dresser units 110, see FIG. 7D also.

The head board 112 is attached to both the dresser unit 110 and the bed frame 114 by screws. The head board 112 has two legs 122 with end caps 66 therein. Two upper supports 124, being tubing 50, are connected to two horizontal supports 126, being tubing 50, by joints 60 and 62. The head board panel 128 is mounted to the flanges of the tubing 50.

Figure 7E:
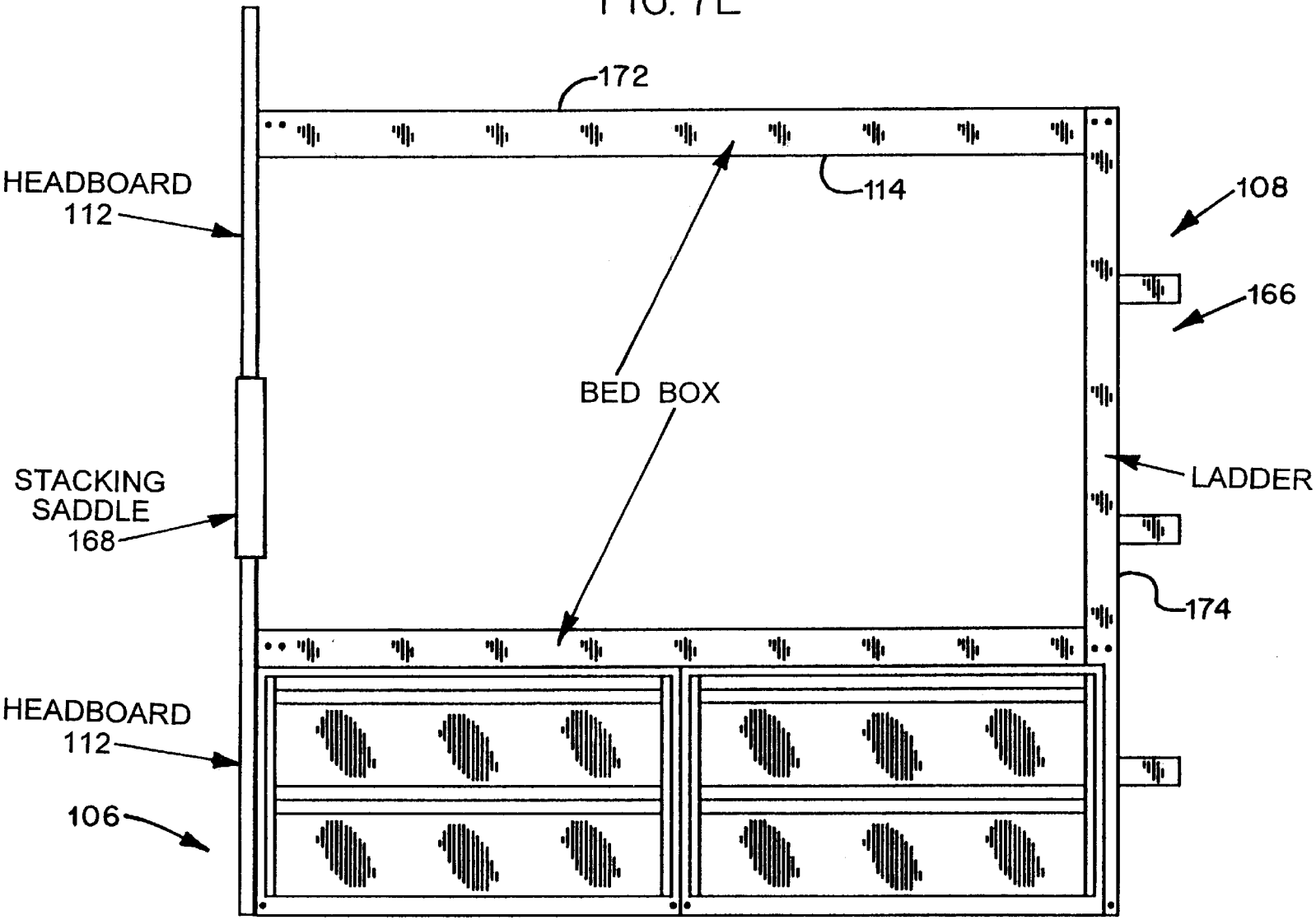
Figure 7F:
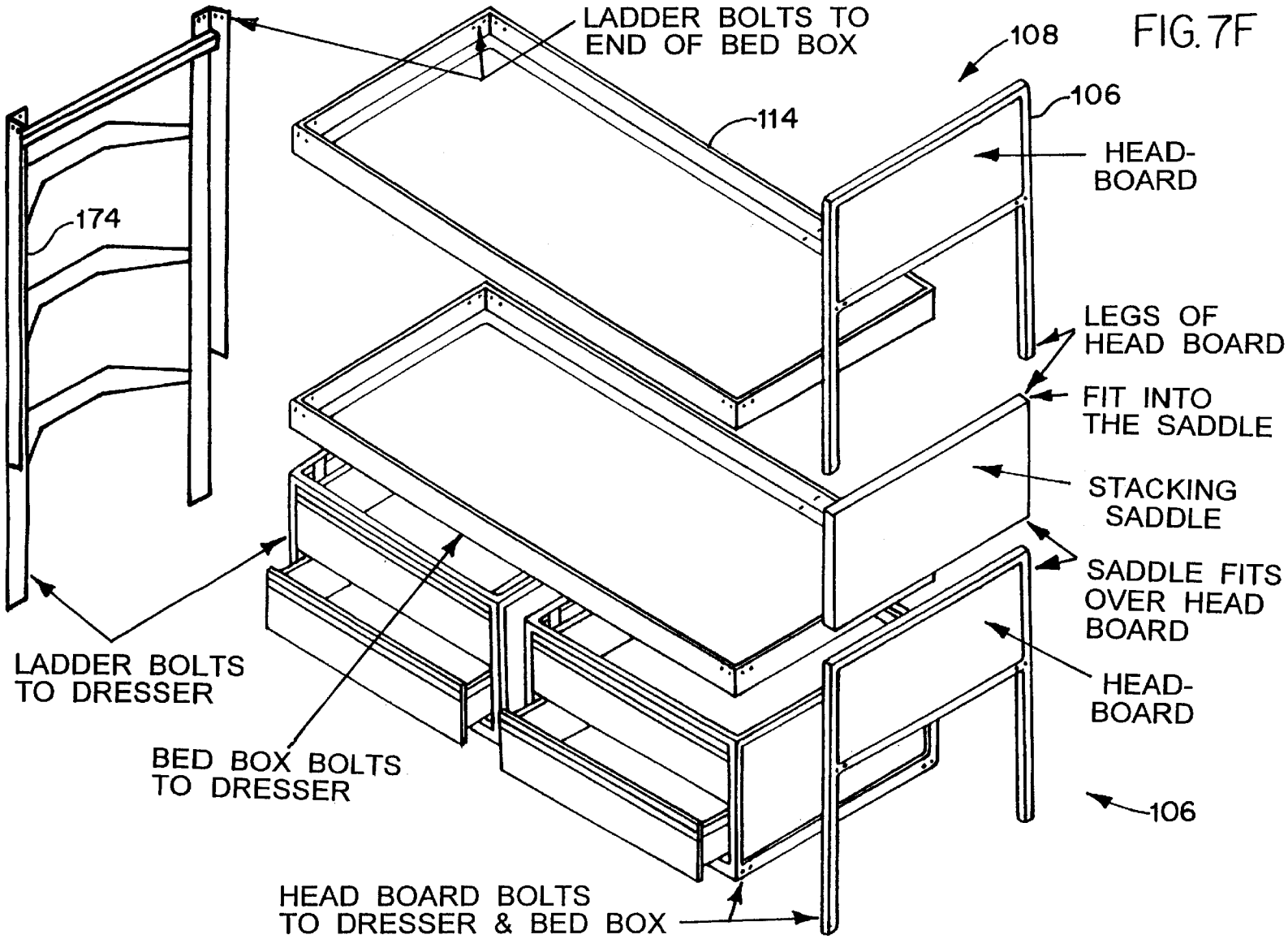
Figure 7H:
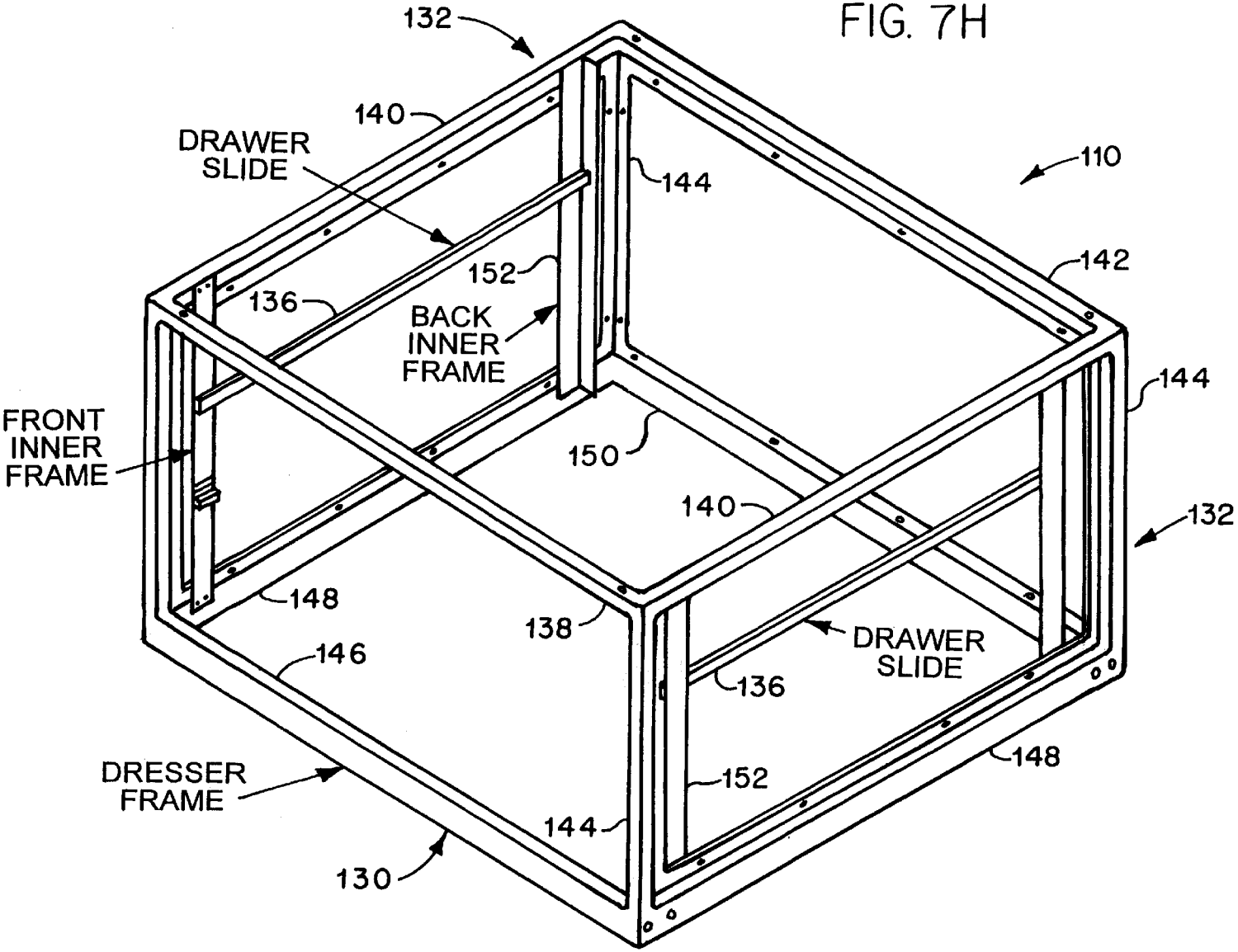
Figure 7I:
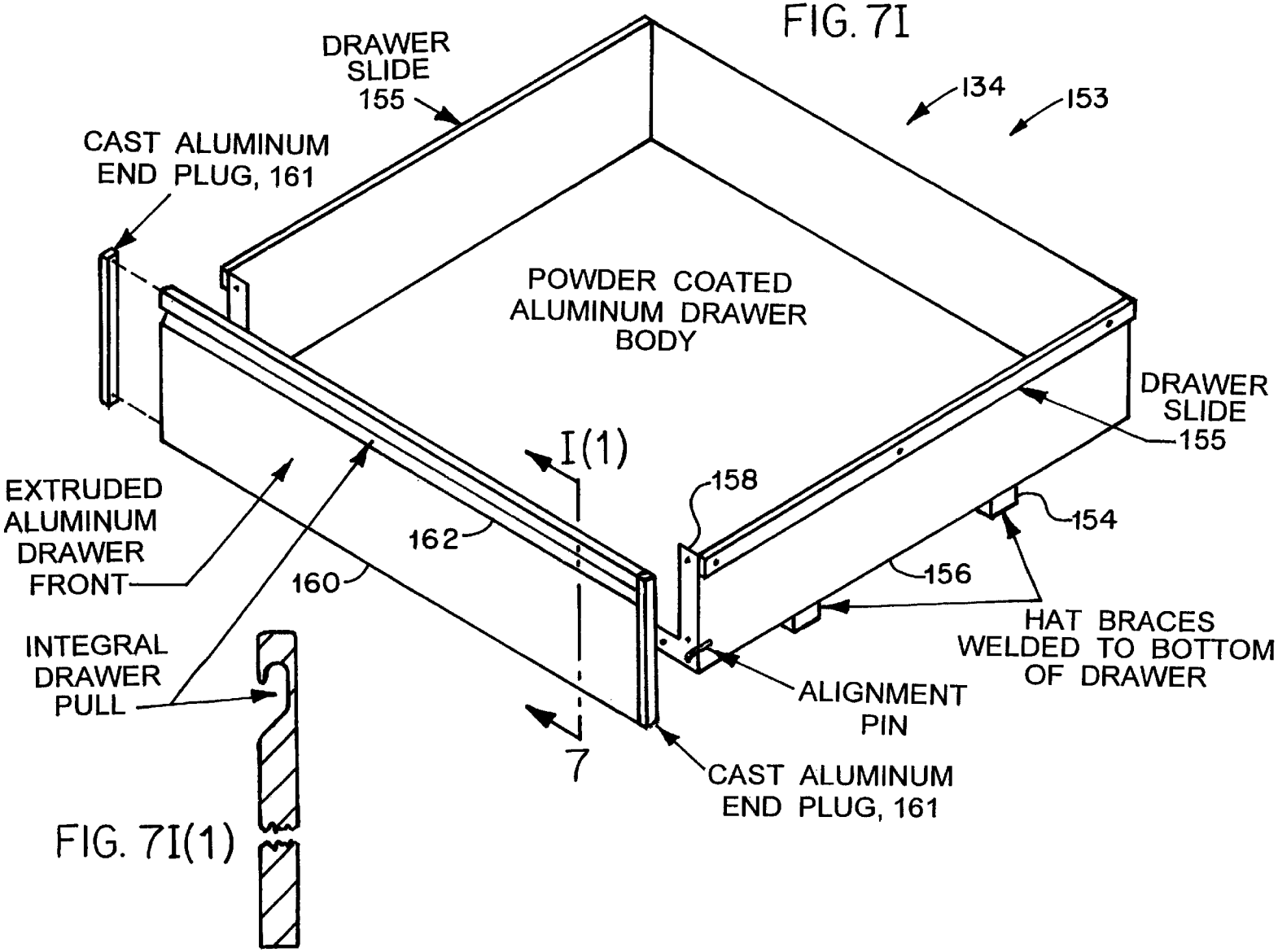

The dresser units 110 are further illustrated in FIGS. 7H to 7J. As seen in FIG. 7H, a dresser frame 130 has a pair of inner frames 152 for holding drawers 134, FIG. 7I. The inner frames 152 are screwed onto the dresser frame 130 and a pair of drawer slides 136 are further attached thereon. The drawer slides 136 are screwed to the front vertical frame with one screw and rest on a supporting tab thereon and the rear attachment is a slot that the drawer slide is captured in. Only one pair is shown in FIG. 7H. Panels are mounted on the outside surfaces of the dresser frame unit 130 and can be moved if the position of the dresser unit 110 is reversed. An upper front edge 138, being only a square tube, is attached to two upper side edges 140, being tubing 50, with joints 64. The upper back edge 142, being tubing 50, is attached to the upper side edges 140 with joints 64. Four vertical supports 144 are attached into the upper tubes with the use of joints 64. The lower base is made of 1 by 2 inch square tubing. The lower front edge 146 being only the rectangular tube, is attached into the lower side edges 148 with joints 68. The two lower side edges 148 are connected to the lower back edge 150, being tubing 56 with joints 68 also. There are four drawer slides 136, of conventional design, such as Hettich 3320-34, only two shown, that are attached to vertical supports 152.

Into each dresser 110 are inserted two dresser drawers 134, FIG. 7I. The drawer body 153 is made of sheet aluminum with hat braces 154 on the bottom 156 for strength. A flange 158 is formed around the front for holding a drawer front 160 made of extruded aluminum with an integral drawer pull 162. End plugs 161 are attached on the ends of the drawer front 160. The drawer front 160 has nutserts therein which are used with screws to hold to the flange 158.

As seen in FIG. 7J, each dresser 110 has two drawers 134 therein and two panels 164 installed in the back and side opens of the frame 132.

In the system of furniture provided, a bunk bed may be desired when more than two persons are in each room. Referring to FIG. 7E, the single bed unit 106 serves as the base with a stacking unit 166 attached to the unit 106 to be described. A stacking saddle 168 goes over the top of the lower head broad 106, FIG. 7G, and rests upon it at an internal baffle 170. The upper headboard 106 has its legs 122 go into the top of the stacking saddle 168. A flat spacer is welded inside of the saddle at the center to hold the saddle in placed. The ladder is constructed of ¼×3×3 inch aluminum angle. Holes are drilled and countersunk at the top and bottom locations to attach the ladder to the foot of the two bed frame with acorn nuts inside the bed frame. Holes are drilled and countersunk at the bottom of the uprights to secure the bottom of the ladder to the bottom of the dresser frame. The steps are made from 3×3×¼ inche angle aluminum and cast with integral treads thereon. The steps are angled in at a 45 degree angle on each side. A horizontal aluminum brace is welled at the top between the uprights to support the upper bed frame during the stacking process. The steps are welded to the uprights. The upper headboard 106 is screwed onto upper frame 172, being the same as the lower frame 114, also called a bed box. A ladder 174 being made of aluminum to conserve weight is screwed onto the opposite end of the upper and lower frame 114. Thus the ladder 174 serves as one of the end supports of the upper bed unit and as a means for getting into the upper bed. An exploded schematic of the sleeping unit is shown in FIG. 7F.

Description of Desk with Bookcase:

In each of the dormitory style rooms, there is one desk and bookcase unit 180 per person being composed of one desk 176 and one bookcase 178 thereon. The bookcase 178 is screwed onto the desk 176.

The bookcase 178 is further detailed in FIGS. 8K to 8Q. A bulletin board 182 is mounted into the lower back of the bookcase 178. The bulletin board 182 has a board 184 mounted into a rectangular frame 186 composed of four tubings 50 with joints 62 therebetween.

The bookcase 178 has two lower supports 188, one lower shelf 190, a middle shelf 192, and an upper shelf 194. The shelves 196, 198, 200 are fitted within the frames. End panels 204 and back panels 206 are also fitted within the frame. The lower support 188 is formed of two vertical supports 208 and a horizontal support 210 being of square tubing with joints 62 therein. The front edge 212 of shelves 196, 198 and 200 are tubing 50. The lower shelf 196 has side and back edges 214 and 216 of tubing 53, FIG. 3I and FIG. 8P. The middle shelf 198 has side and back edges 218 and 220 of tubing 52, FIG. 8N. The upper shelf 200 has side and back edges 222 and 224 of tubing 40, FIG. 8M. The lower shelf and middle shelf 196 and 198 are jointed with joints 44 and the upper shelf 200 is jointed thereto with joints 64. All paneling is finished on both side where exposed and all tubing and joints are finished with a powder coating.

Figure 8A:
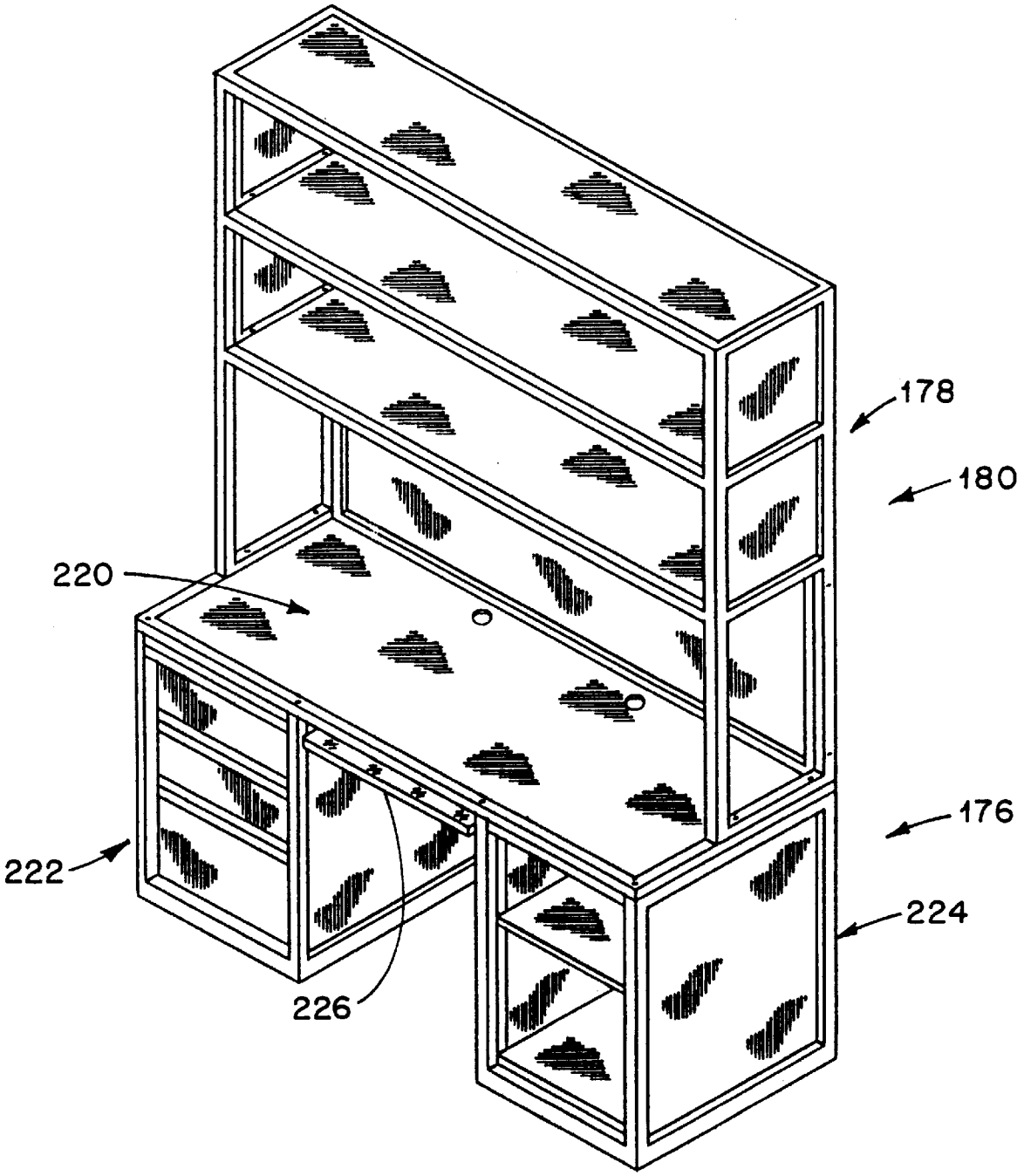
FIGS. 8A to 8P illustrate a desk and bookcase unit of the present invention.

The bookcase 178 is screwed onto the desk unit 176 as shown in FIG. 8A. As seen therein the desk 178 has a desk top 220, a desk drawer pedestal 222, a computer pedestal 224, and a keyboard tray 226. The pedestals 222 and 224 are interchangeable left to right under the desk top 220.

The desk drawer pedestal 222 is further detailed in FIG. 8B. The pedestal 222 has a frame 228 with an inner frame 230 mounted thereto for mounting of a file drawer 232, two utility drawers 234 and a pull out work surface 236. Panels 238, 240 and 242 are mounted in the frame 228 and have HPL 244 on the outer surface and a backer 246 mounted to the inner surface.

The frame 228 has 1×2 inch tubes for the base 248 and 1×1 tubes for the rest of the frame. These tubes are attached together with the joint 68 at the bottom corners 250, the joint 64 at the top back corners 252 and the joint 62 at the front corners 254. Each of the tubes has an appropriate attachment flange 256 except the lower front base 258. A drawer locking device 260 may be attached to one of the front vertical tubes in the frame 228. Greater detail of the locking device 260 is shown in FIG. 8C1 where a hasp 270 is attached. The inner frame 230 has a front and rear inner support 262 and 264, respectively, attached to the pedestal frame 228 with screws. Slide support tabs 266, 12 items, are mounted to the supports 262. Slots are provided to insert the slide rails 268 in the rear vertical supports 264 for mounting the drawers. The slide rails in the desk are mounted similar to those in the dresser. slide rails 268 mounted thereon for holding the drawers, desk drawer slides may be Accuride 4032 or equal.

Figure 8D:
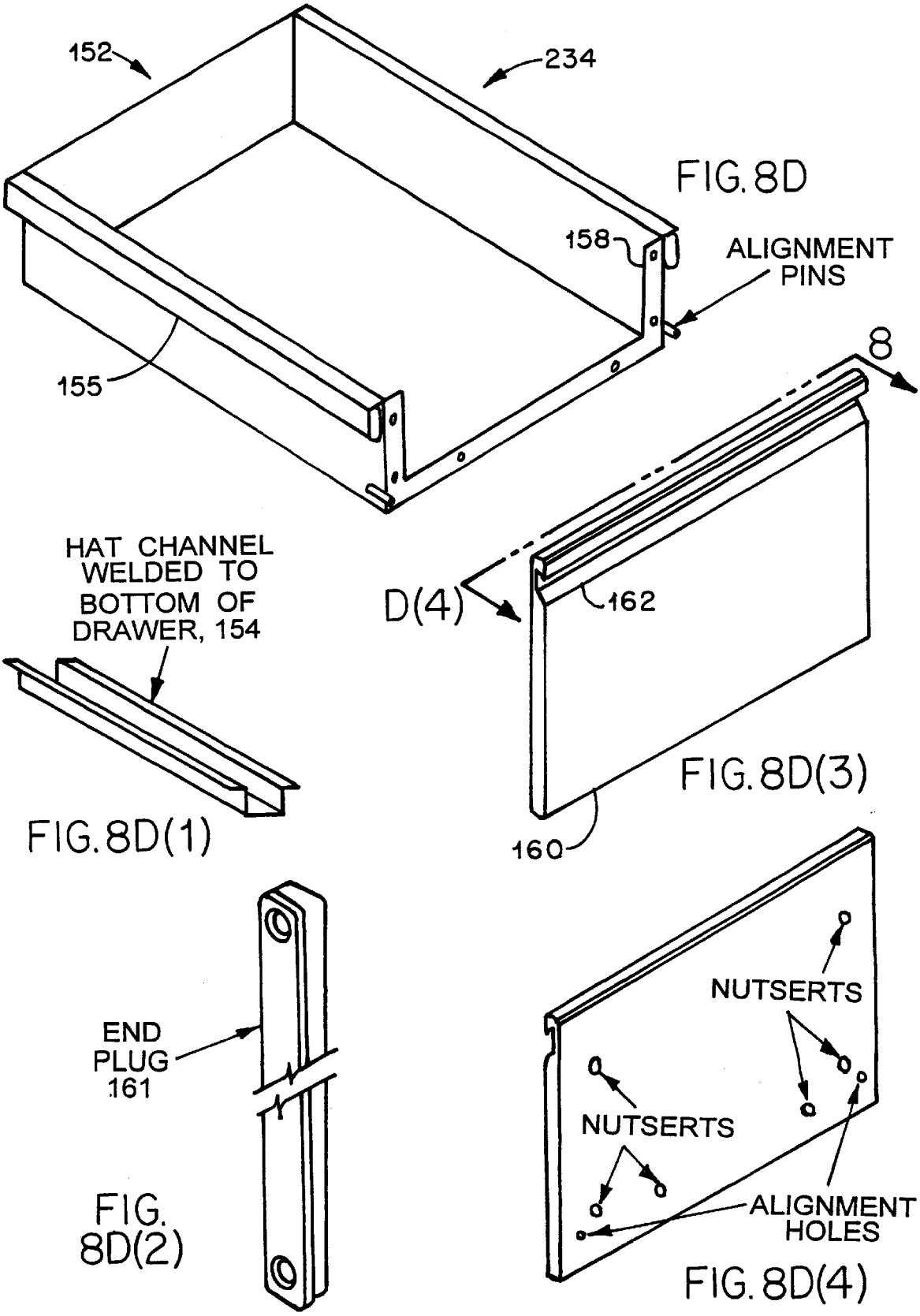
Figure 8E:
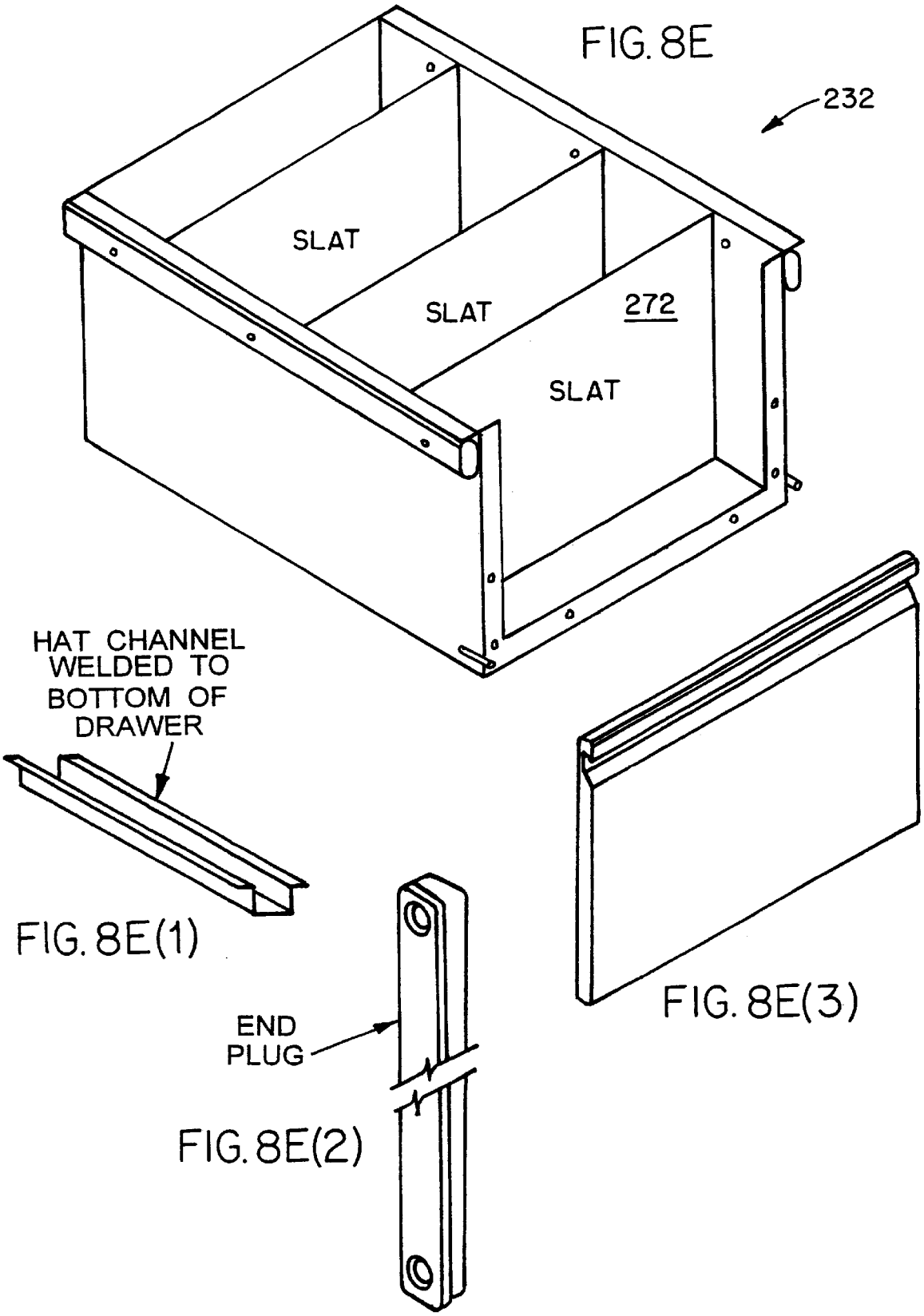

The utility drawer 234 is shown in FIG. 8D and is of similar construction as the dresser drawer 134 as shown in FIG. 7I. The file drawer is shown in FIG. 8E and is similar construction as that of the utility drawer 234. A plurality of dividers 272 are adjustably mounted in the drawer 232.

The computer pedestal 224 is shown in FIG. 8F. A pedestal frame 274 is constructed similarly as the pedestal frame 228. A pull out work surfaces 276 and 278 are mounted in the top and bottom positions. FIG. 8F1 illustrates wheels 280 rolling on a L shaped support 282 attached to the frame 274. A fixed shelf 284, being adjustable vertically, is mounted to the frame 274 as shown in FIG. 8F2 wherein a T bracket 286 is screwed thereon. Panels 288 and 290 are mounted on the outside and the backside with the inside left vacant so that there is easier access to a computer printer placed on the shelf.

Figure 8G:
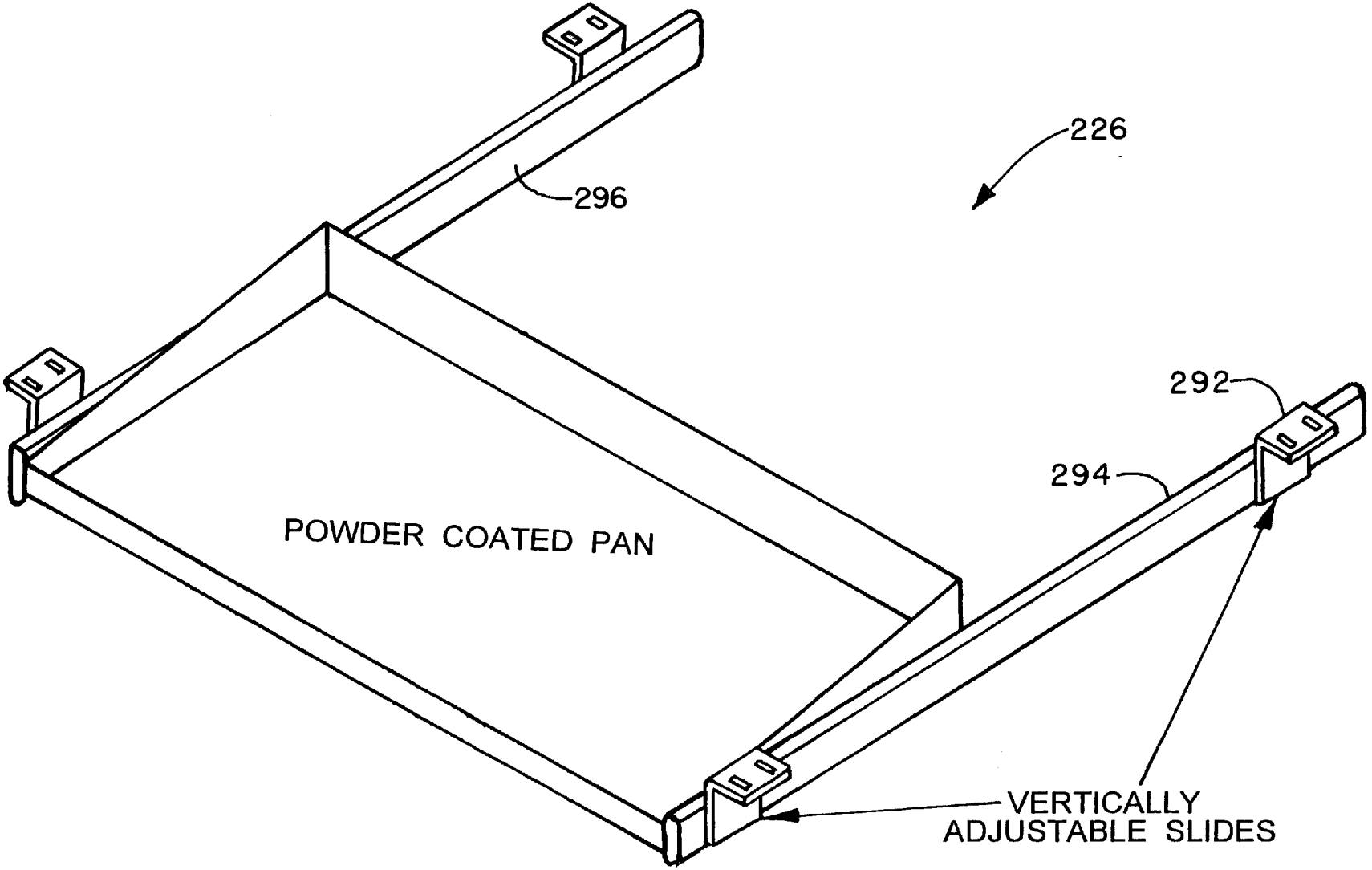

The keyboard tray 226 is illustrated in FIG. 8G. Brackets 292 are mounted to the bottom side of the desk top and are further attached to a slide support 294 which holds a slide 296 therein.

Figure 8H:
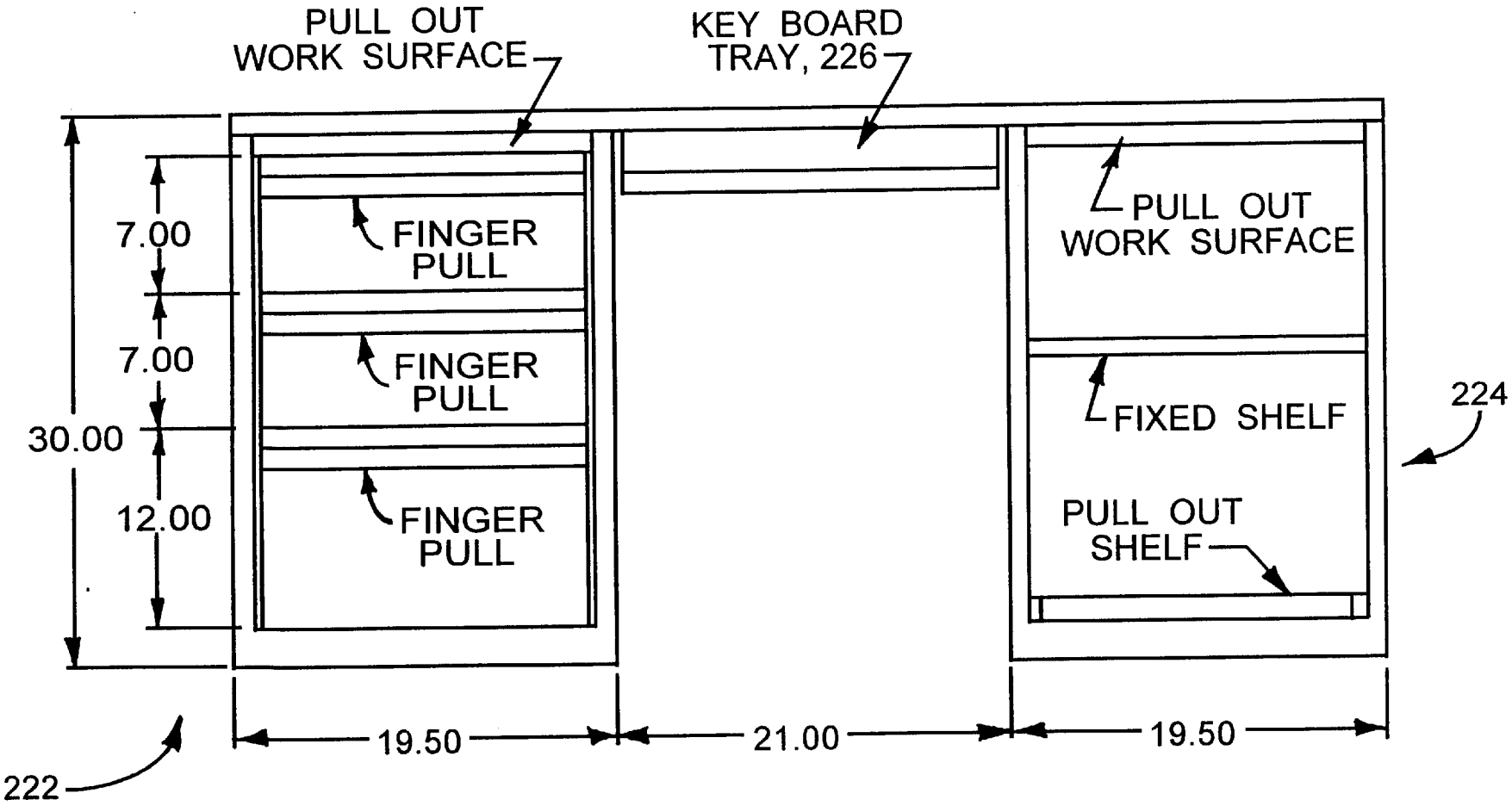
Figure 8I:
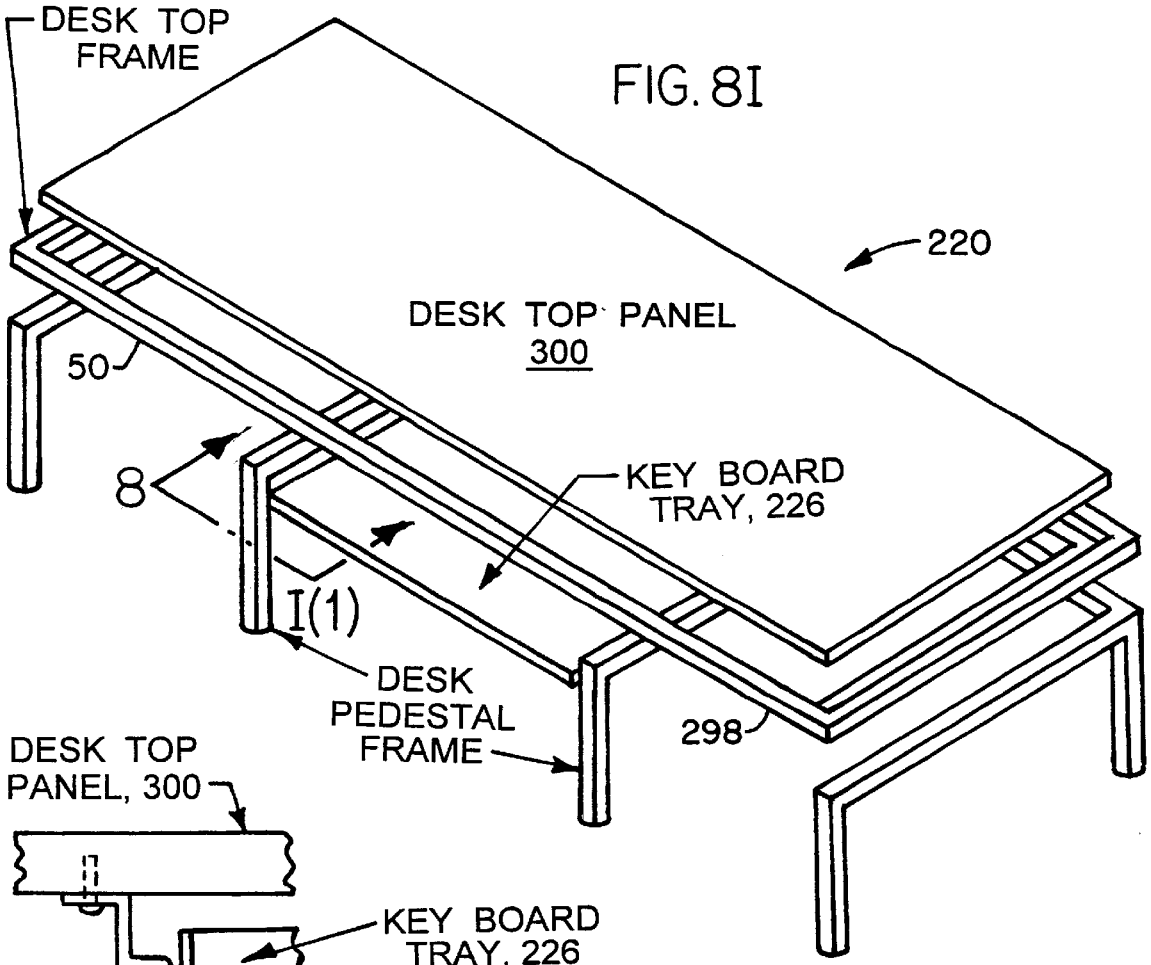
Figure 8J:
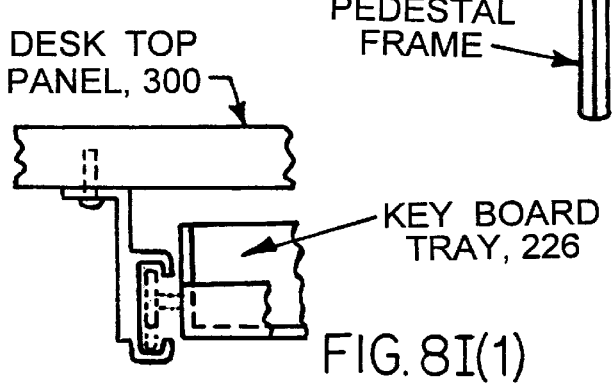
Figure 8J:
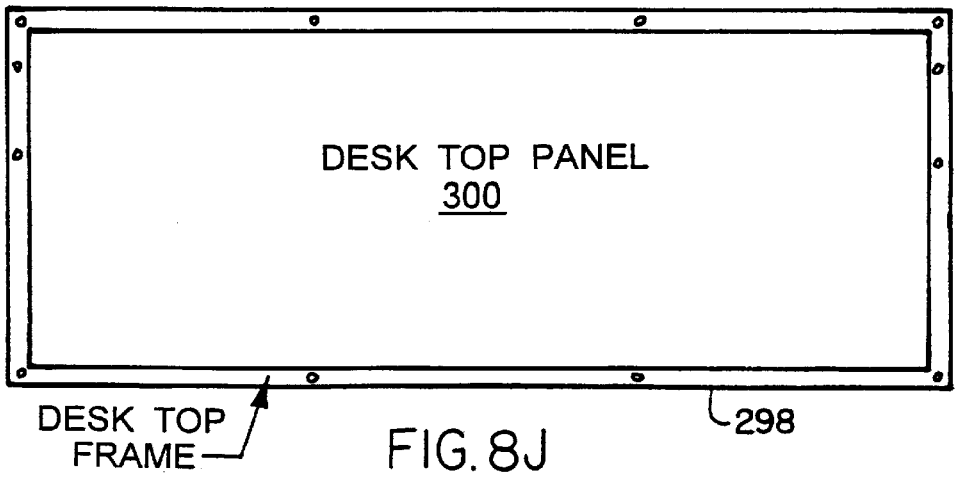
Figure 8K:
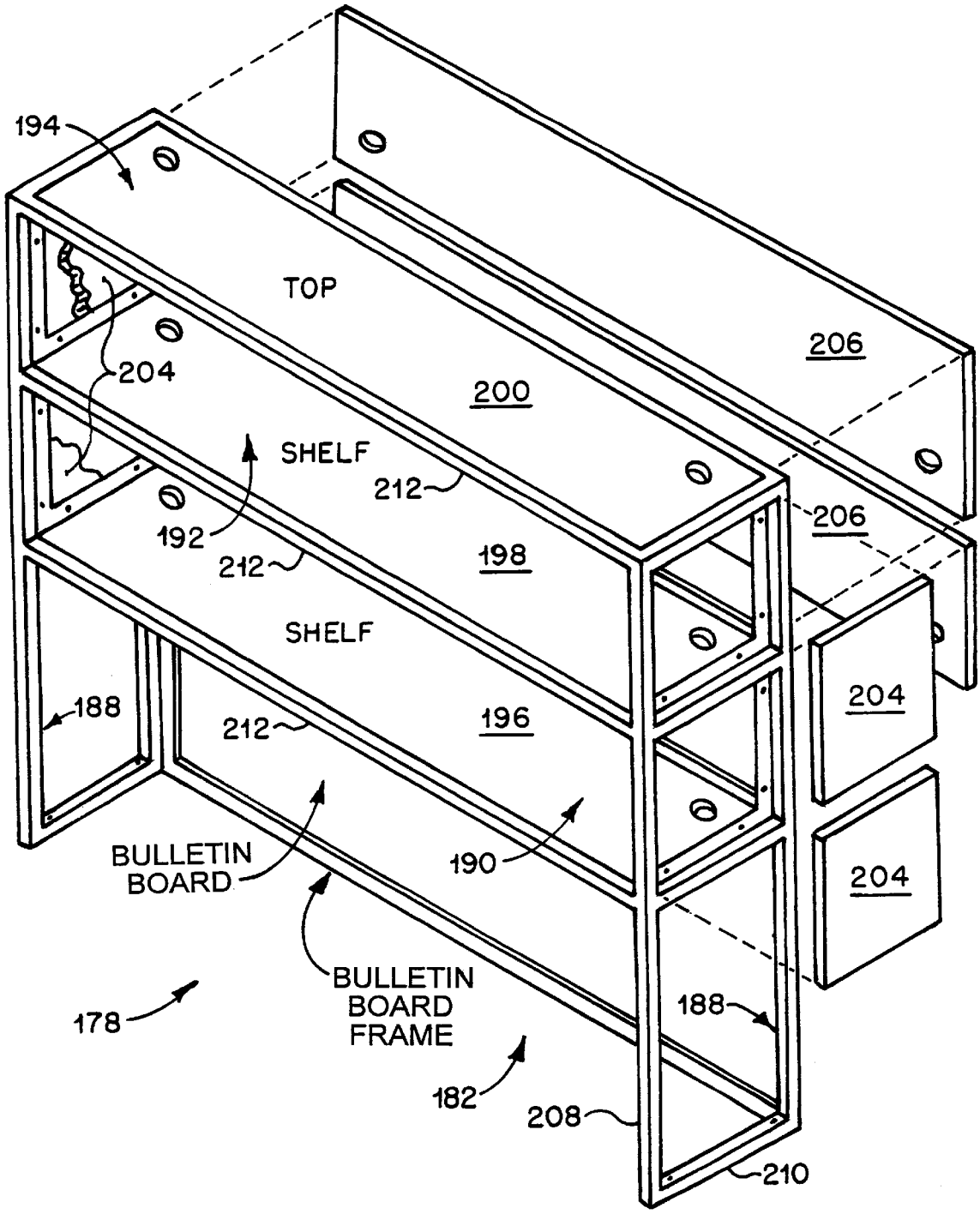
Figures 8L, 8M, 8N, 8O, 8P:
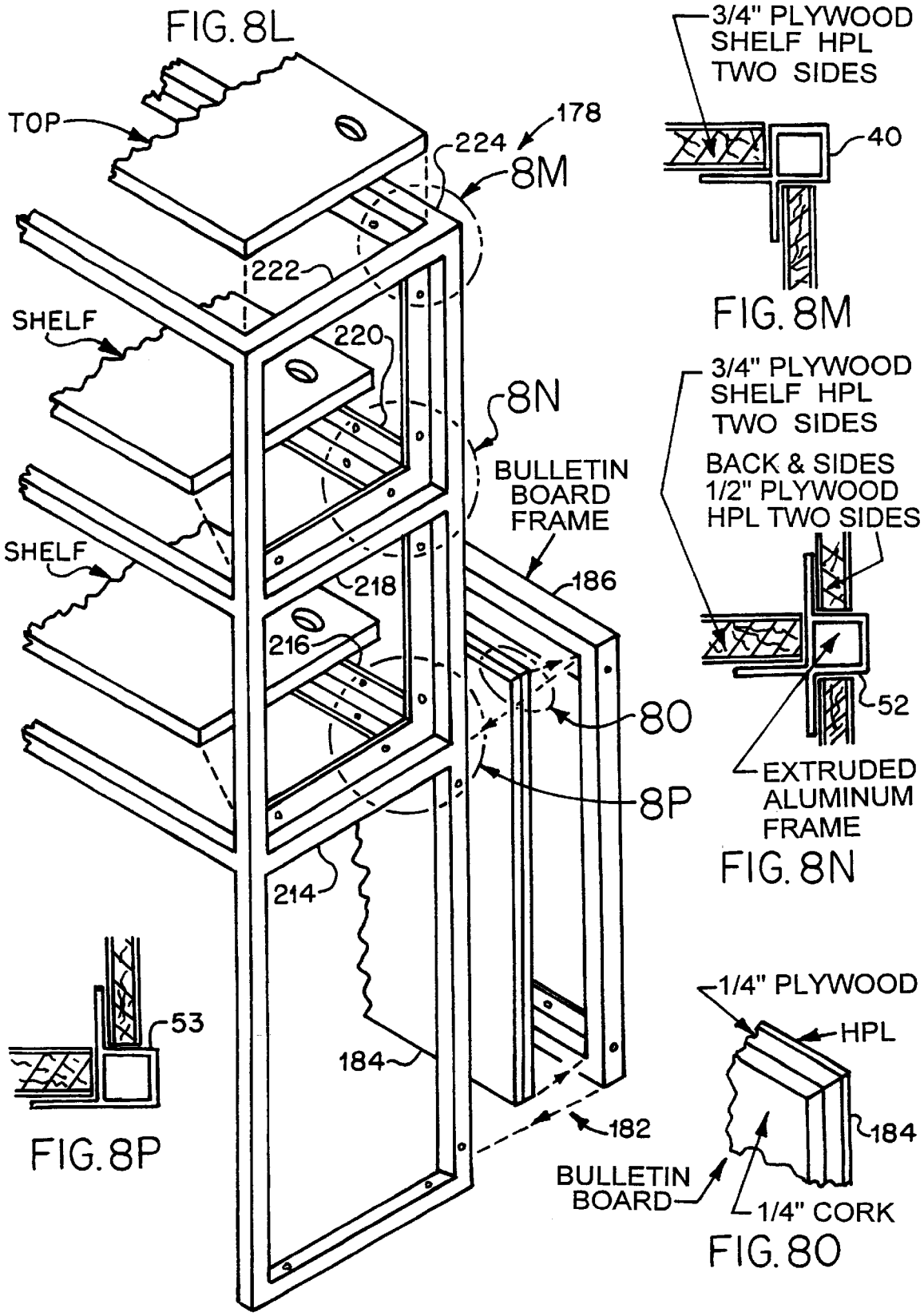

FIG. 8I illustrates the desk top 220 having a frame 298 made of 1×1 tubing 50 being jointed at the corners by joints 62. This frame 298 is screwed onto the top of the pedestals 222 and 224 as shown in FIG. 8H. A desk top panel 300 is inserted into the frame 298 being screwed therein by side mounted screws.

Figure 9B:
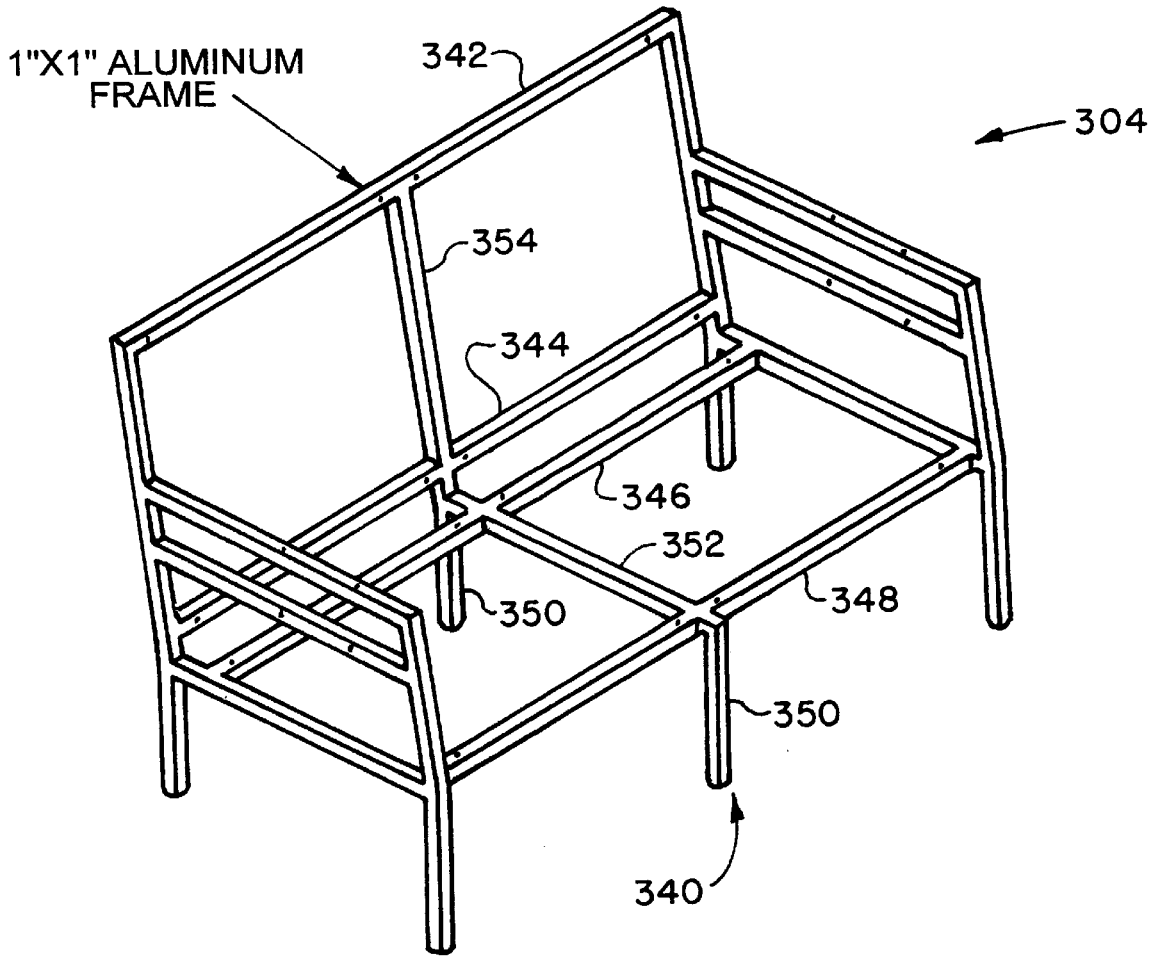
Figure 9C:
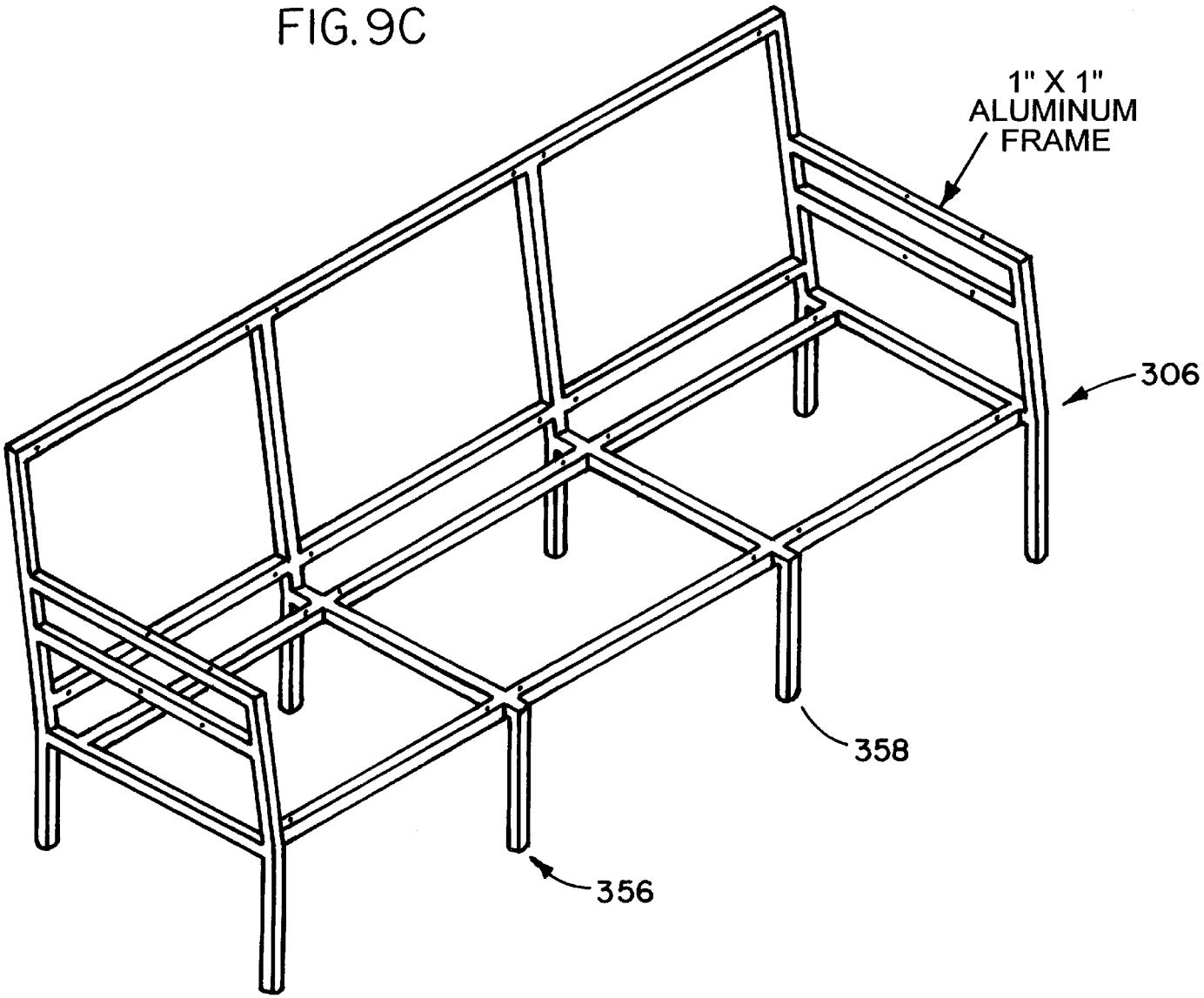
Figure 9E:
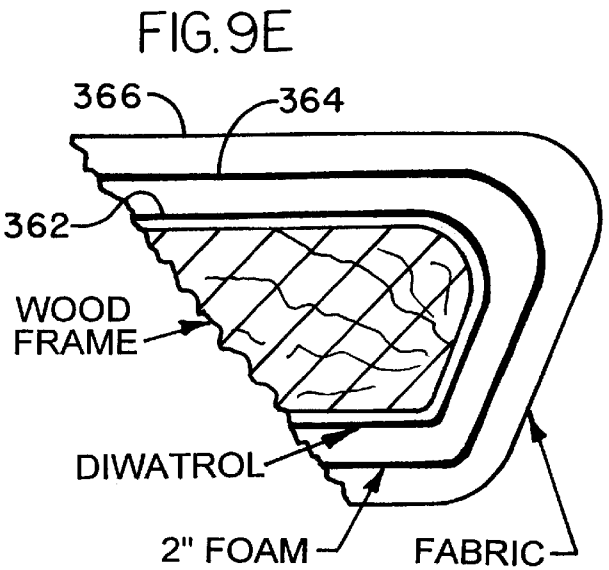

Description of Seating Units:

Seating for the desks are of conventional office design with wheels mounted on the base legs. Additional seating in the dormitory style rooms or common areas is provided by one or more lounge chairs 302, a two seated sofa 304, and a three seated sofa 306 as illustrated in FIGS. 9A, 9B and 9C.

Each seating unit is made from 1×1 aluminum stock with joints welded and/or placed together with cast aluminum inserts as shown in FIG. 4. All joints are ground smooth and covered by the powder coated finish, for example. All arm rests and seats are attached to the seat frame with screws. The arm rests are interchangeable and the seats and backs are also interchangeable. This flexibility provides for a high degree of maintainability because the parts of a lounge chair, two seat sofa and three seat sofa are all interchangeable.

Figure 9D:
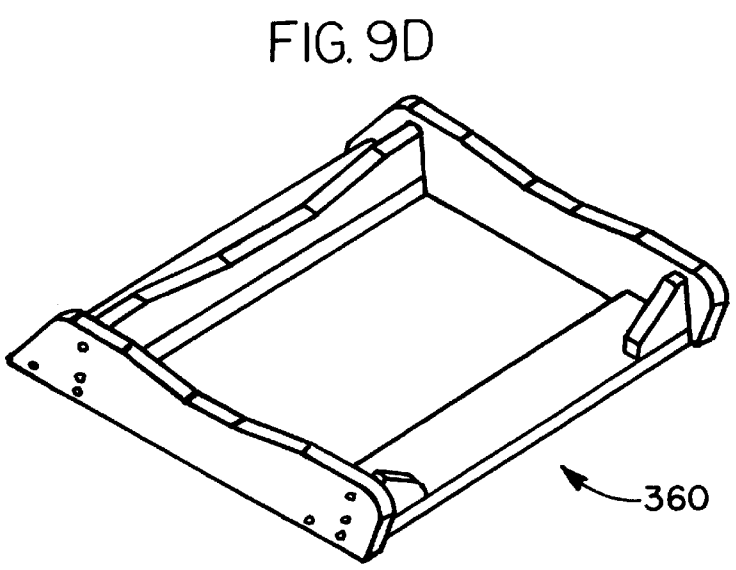
Figure 9G:
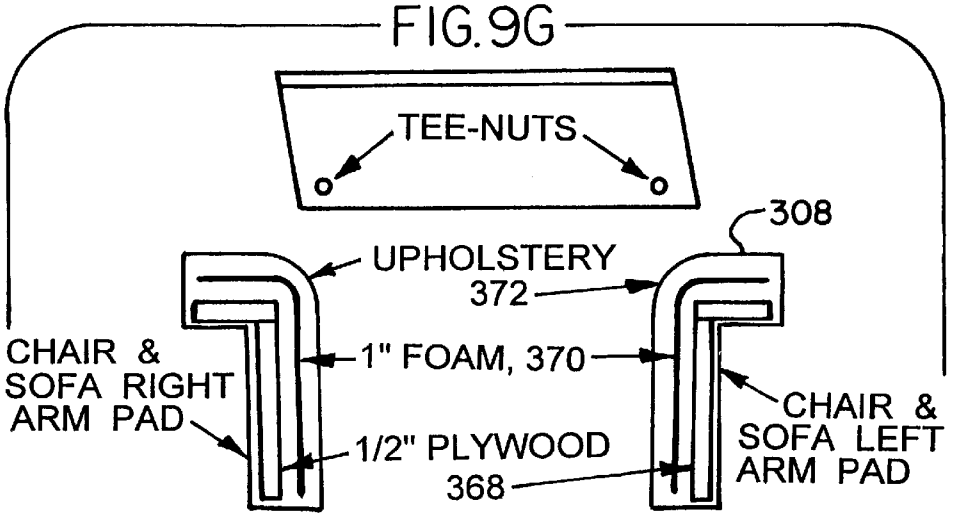
Figure 9F:
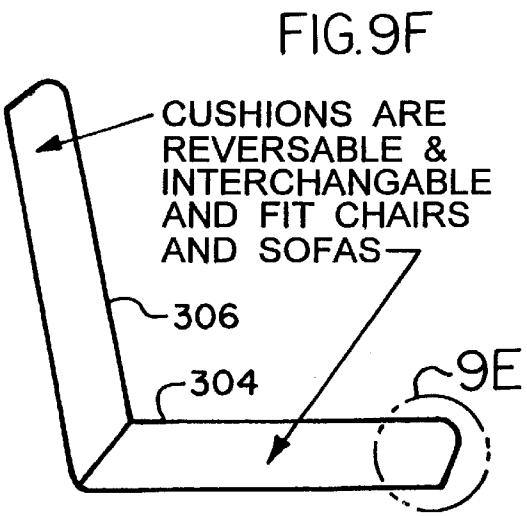

Referring to FIG. 9A(1), the lounge chair 302 is shown without the seat 304 or back 306, FIG. 9F, thereon. Also the arm rests 308, FIG. 9G, are not attached.

The chair 302 frame 310 has two seat supports 312 and 314 and two back supports 316 and 318. The seat supports 312 and 314 are attached to two side supports 320 and 322 and the back supports are attached to two side supports 324 and 326. Four legs 328 are attached to the side supports 320 and 322. At the bottom of each leg 328 are end caps 338, FIG. 9A(3). The arm rest 330 has a vertical support 332 and two horizontal supports 334 and 336.

FIG. 9B illustrates a seat sofa 304. The two seat sofa 304 is similarly constructed as the chair 302 but with the addition of an common support 340 between the extended seat and back supports 342, 344, 346 and 348. This common support 340 consists of two legs 350, a center seat support 352 and center back support 354. As noted above, the seats and backs and arm rests of the lounge chair are usable on the sofas of whatever length.

FIG. 9C illustrates the three seat sofa 306 having two common supports 356 and 358.

Each seat or back may have a wooden base 360, FIG. 9D, upon which is mounted a Dupont Dymetrol support 362, 2 inches of foam 364 and an fabric cover 366. Two inches of medium density poly form will be fitted over the base and wrapped around the bullnose of the wooden base to furnish cushioning. The seat and back cushions will be attached with four screws per cushion. Each arm rest has a plywood frame 368 with a foam base 370 and a fabric cover 372. The arm pad wood structure will be constructed of a furniture grade ½ inch plywood and t-nuts will be used to secure the arm pad to the frame with four flat head counter-sunk phillips head screws. This applies to any screws in the metal parts of the present invention. All exposed areas of the cushions, backs, arm rests will have a fabric cover of matching material.

Clearly, many modifications and variations of the present invention are possible in light of the above teachings and it is therefore understood, that within the inventive scope of the inventive concept, the invention may be practiced otherwise than specifically claimed.

What is claimed is:

1. A sleeping unit for furnishing a standardized room with modularized units of furniture being totally user maintainable and user configurable with the use of a single screw driver, said sleeping unit comprising:

a single bed and dresser, said single bed and dresser having means thereon for attachment of a ladder unit and a saddle unit, said dresser comprising of two separate external frames, each of said separate external frames having two drawers each therein, both drawers being located on a same face of said external frame, each frame being reversible side-to-side and front-to-back of said single bed whereby said drawers in adjacent frame units may have the drawers open on the opposite or the same side of said single bed; said single bed having a bed box and a headboard, said bed box attached to tops of said dresser and said headboard attached to one of said external frames.

2. A sleeping unit for furnishing as defined in claim 1 further including one stacking unit for attachment to said single bed and said dresser to make a bunk bed combination, said stacking unit comprising said ladder unit, said saddle unit, a head board and a bed box, said ladder unit attaching to said single bed and said bed box, said saddle unit being attached to a head board of said single bed and to legs of said head board of said stacking unit.

3. A sleeping unit for furnishing as defined in claim 1 wherein said single bed and dresser comprises:

a first dresser unit, said dresser unit having said external frame and two drawers therein;

a second dresser unit, said dresser unit having said external frame and two drawers therein, said first and said second dresser units being similar, said second dresser unit being placed next to said first dresser unit, the drawers in said first and said second dresser units facing in the same or opposite direction at the option of the user;

a head board, said head board being attached to said second dresser unit at either end of said bed;

a bed box, said bed box comprising a bed frame and a bed board attached to said bed frame, said bed box being attached to the tops of said dresser unit.

4. A sleeping unit for furnishing as defined in claim 3 wherein said dresser unit comprises:

a rectangular box-like frame, said rectangular box-like frame being constructed of 1×1 aluminum tubing and welded joints, said frame having a base constructed of 1×2 aluminum tubing and welded joints connected to said 1×1 tubing, said tubing having appropriate flanges thereon for the attachment of panels;

two panels, said panels being inserted into said frame to form outer surfaces thereon, said panels having a durable coating thereon;

a pair of inner frames with drawer slides thereon, said inner frames attached inside and thereto said box-like frame; a rear inner frame having two openings therein defining two slots, each of said slides having a single screw onto a front end of said slides, a rear of said slides resting in said slot of a rear inner frame whereby said slide is easily removable for repair by removing the only screw on said front of said slide which allows the slide to be removed without further effort; and a pair of drawers, said drawers being mounted to said drawer slides.

5. A sleeping unit for furnishing as defined in claim 2 wherein said stacking unit comprises:

said saddle unit, said saddle unit being a rectangular box-like container, a top and a bottom of said container being open, said saddle unit having an internal baffle attached midway between said top and bottom, a head board of said single bed closely fitting into said bottom, a pair of legs of said head board on said top resting upon said internal baffle, said head board of said stacking unit having legs which closely fit within said top of said saddle unit, said legs resting upon said internal baffle;

a head board for said stacking unit, said head board for said stacking unit being similar to said head board of said single bed;

a bed box, said bed box being attached at one end to said head board of said stacking unit; and said ladder unit, said ladder unit being made of aluminum stock, said ladder unit having steps thereon, said ladder unit having a pair of vertical supports upon which said steps are attached, said vertical supports attached on a bottom to said first dresser unit and said bed box of said single bed and attached on a top to said bed box of said stacking unit.

* * * * *